US007364510B2

(12) United States Patent
Walker et al.

(10) Patent No.: US 7,364,510 B2
(45) **Date of Patent: *Apr. 29, 2008**

(54) APPARATUS AND METHOD FOR FACILITATING TEAM PLAY OF SLOT MACHINES

(75) Inventors: Jay S. Walker, Ridgefield, CT (US); James A. Jorasch, Stamford, CT (US); Magdalena M. Fincham, Ridgefield, CT (US); Geoffrey M. Gelman, Stamford, CT (US); Robert C. Tedesco, Huntington, CT (US)

(73) Assignee: Walker Digital, LLC, Stamford, CT (US)

( * ) Notice: Subject to any disclaimer, the term of this patent is extended or adjusted under 35 U.S.C. 154(b) by 320 days.

This patent is subject to a terminal disclaimer.

(21) Appl. No.: 10/811,583

(22) Filed: Mar. 29, 2004

(65) Prior Publication Data

US 2004/0204235 A1 Oct. 14, 2004

Related U.S. Application Data

(63) Continuation-in-part of application No. 10/067,576, filed on Feb. 6, 2002, now Pat. No. 6,712,699, which is a continuation-in-part of application No. 09/590,021, filed on Jun. 8, 2000, now Pat. No. 6,361,441, which is a continuation of application No. 09/052,835, filed on Mar. 31, 1998, now Pat. No. 6,142,872.

(51) Int. Cl.
*A63F 9/24* (2006.01)

(52) U.S. Cl. ..... 463/42; 463/20; 463/23; 463/13

(58) Field of Classification Search ..... None
See application file for complete search history.

(56) References Cited

U.S. PATENT DOCUMENTS

| | | | | |
|---|---|---|---|---|
| 4,636,951 | A | 1/1987 | Harlick | 364/412 |
| 4,669,731 | A | 6/1987 | Clarke | 273/143 R |
| 4,773,647 | A * | 9/1988 | Okada et al. | 273/143 R |
| 4,837,422 | A | 6/1989 | Dethloff et al. | 235/380 |
| 4,837,728 | A | 6/1989 | Barrie et al. | 364/412 |

(Continued)

FOREIGN PATENT DOCUMENTS

GB 2 161 008 A 1/1986

OTHER PUBLICATIONS

Grochowski, John, "Players Look for Edge With Casino Gimmicks", Chicago Sun-Times, Aug. 25, 1995, Section: Weekend Plus, Gaming, p. 15, NC.

(Continued)

*Primary Examiner*—M. A Sager
(74) *Attorney, Agent, or Firm*—Walker Digital Management, LLC

(57) ABSTRACT

A method for team play of slot machines, including determining a first result corresponding to a first player on a team, determining a second result corresponding to a second player, determining whether the second player is on the team, and determining a result based on the first result and the second result if the second player is on the team. Various embodiments further include awarding comp points to the team based on the play of the first player and the second player. Various embodiments further include joint participation in a bonus round by members of a team.

28 Claims, 29 Drawing Sheets

U.S. PATENT DOCUMENTS

| | | | | | |
|---|---|---|---|---|---|
| 4,838,552 | A | * | 6/1989 | Hagiwara | 463/20 |
| 5,042,818 | A | | 8/1991 | Weingardt | 273/292 |
| 5,083,271 | A | * | 1/1992 | Thacher et al. | 700/92 |
| 5,116,055 | A | | 5/1992 | Tracy | 273/138 A |
| 5,123,649 | A | | 6/1992 | Tiberio | 273/143 R |
| 5,173,851 | A | | 12/1992 | Off et al. | 364/401 |
| 5,178,390 | A | | 1/1993 | Okada | 273/143 R |
| 5,179,517 | A | | 1/1993 | Sarbin et al. | 364/410 |
| 5,275,400 | A | | 1/1994 | Weingardt et al. | 273/85 CP |
| 5,280,909 | A | | 1/1994 | Tracy | 273/138 A |
| 5,324,035 | A | | 6/1994 | Morris et al. | 273/138 A |
| 5,342,049 | A | | 8/1994 | Wichinsky et al. | 273/119 R |
| 5,377,973 | A | | 1/1995 | Jones et al. | 273/85 CP |
| 5,393,057 | A | * | 2/1995 | Marnell, II | 463/13 |
| 5,393,061 | A | | 2/1995 | Manship et al. | 273/143 R |
| 5,409,225 | A | | 4/1995 | Kelly et al. | 273/138 R |
| 5,472,194 | A | | 12/1995 | Breeding et al. | 273/138 A |
| 5,482,289 | A | | 1/1996 | Weingardt | 273/269 |
| 5,531,440 | A | | 7/1996 | Dabrowski et al. | 463/12 |
| 5,559,312 | A | | 9/1996 | Lucero | 235/380 |
| 5,564,700 | A | | 10/1996 | Celona | 463/27 |
| 5,580,309 | A | | 12/1996 | Piechowiak et al. | 463/16 |
| 5,611,535 | A | | 3/1997 | Tiberio | 273/143 R |
| 5,611,730 | A | | 3/1997 | Weiss | 463/20 |
| 5,621,201 | A | | 4/1997 | Langhans et al. | 235/380 |
| 5,639,088 | A | | 6/1997 | Schneider et al. | 273/138.2 |
| 5,655,961 | A | | 8/1997 | Acres et al. | 463/27 |
| 5,674,128 | A | | 10/1997 | Holch et al. | 463/42 |
| 5,755,621 | A | * | 5/1998 | Marks et al. | 463/42 |
| 5,761,647 | A | | 6/1998 | Boushy | |
| 5,768,382 | A | * | 6/1998 | Schneier et al. | 380/251 |
| 6,010,404 | A | * | 1/2000 | Walker et al. | 463/21 |
| 6,039,648 | A | * | 3/2000 | Guinn et al. | 463/16 |
| 6,142,872 | A | | 11/2000 | Walker et al. | 463/16 |
| 6,206,782 | B1 | * | 3/2001 | Walker et al. | 463/25 |
| 6,312,332 | B1 | * | 11/2001 | Walker et al. | 463/23 |
| 6,361,441 | B1 | | 3/2002 | Walker et al. | 463/42 |
| 6,364,765 | B1 | | 4/2002 | Walker et al. | 463/16 |
| 6,712,699 | B2 | * | 3/2004 | Walker et al. | 463/30 |
| 6,733,390 | B2 | * | 5/2004 | Walker et al. | 463/23 |

OTHER PUBLICATIONS

Rose, Bob, "New Ways For the House to Win", St. Louis Post-Dispatch, Oct. 3, 1996, Section: Get Out, p. 50.

"Hot Slots & Reel Deals", Atlantic City Insider, Oct. 1996, vol. 1, No. 2.

"Triple Play Draw Poker Takes Casino Industry By Storm", IGT Press Releases, Feb. 18, 1998, (http //www igtgame com/press/02-18-98 html).

Website: Brokopp, John G., "One Way to Manipulate Player's Clubs", Casino City Times, Feb. 6, 2001, (http //brokopp casinocitytimes com/articles/534 html).

Dancer, Bob and Compton, Jeffrey, "Player's Edge: Cannery's machines tighter than most locals' casinos", Las Vegas Review-Journal (Nevada), Jan. 10, 2003.

Website: Brokopp, John G, "Player's Club Strategy for Couples", Casino City Times, Dec. 3, 2003, (http //brokopp casinocitytimes com/articles/8065 html).

Website: "Tunica Casino Slot and Table Play Club", (http //www tunica-ms com/casino_slot_clubs htm), download date: Mar. 26, 2004.

* cited by examiner

600

| PLAYER IDENTIFIER 630 | PLAYER NAME 635 | ADDRESS 640 | TEAM IDENTIFIER 630 | REWARD POINTS BALANCE 635 |
|---|---|---|---|---|
| 2370493 | JOHN SMITH | 15 RIVER PL. TOWN, USA | 31157 | 500 |
| 2370964 | SUSAN GREEN | 18 MAIN ST. CITY, USA | 31157 | 2,000 |
| 4558123 | MIKE DOE | 30 ROAD DR. VILLAGE, USA | 22182 | 173 |
| 2370964 | JUDY GOLD | 10 BROAD ST. METRO, USA | NONE | 10,563 |

605 610 615 620

FIG. 6

700

| TEAM IDENTIFIER 720 | 1ST PLAYER IDENTIFIER 725 | 2ND PLAYER IDENTIFIER 730 | 3RD PLAYER IDENTIFIER 735 | SESSION DURATION 740 |
|---|---|---|---|---|
| 31157 | 2370493 | 2370964 | 3411190 | 1 HOUR |
| 22182 | 4558123 | 9003418 | 7789013 | 100 PULLS |

705 710

FIG. 7

900

| TEAM IDENTIFIER 920 | PLAYER 1 930 | | | | | PLAYER 2 940 | | | | | PLAYER 3 950 | | | | |
|---|---|---|---|---|---|---|---|---|---|---|---|---|---|---|---|
| | PLAYER ID 931 | REEL 1 932 | REEL 2 933 | REEL 3 934 | MACHINE ID 935 | PLAYER ID 941 | REEL 1 942 | REEL 2 943 | REEL 3 944 | MACHINE ID 945 | PLAYER ID 951 | REEL 1 952 | REEL 2 953 | REEL 3 954 | MACHINE ID 955 |
| 31157 | 4558123 | BELL | ORANGE | BELL | 987654 | 9003418 | CHERRY | BAR | CHERRY | 765432 | 7789013 | BAR | CHERRY | BELL | 543210 |
| 34156 | 6700251 | BAR | CHERRY | CHERRY | 876543 | 8001372 | BELL | BAR | CHERRY | 654321 | 0926617 | BELL | BELL | BAR | 432109 |

905 910

FIG. 9

1000

| TEAM IDENTIFIER 1020 | PLAYER 1 1030 | | | | | PLAYER 2 1040 | | | | | PLAYER 3 1050 | | | | |
|---|---|---|---|---|---|---|---|---|---|---|---|---|---|---|---|
| | PLAYER ID 1031 | MACHINE ID 1032 | COIN IN 1033 | COIN OUT 1034 | NET TOTAL 1035 | PLAYER ID 1041 | MACHINE ID 1042 | COIN IN 1043 | COIN OUT 1044 | NET TOTAL 1045 | PLAYER ID 1051 | MACHINE ID 1052 | COIN IN 1053 | COIN OUT 1054 | NET TOTAL 1055 |
| 31157 (1005) | 2370493 | 123456 | 100 | 120 | +20 | 4599014 | 123457 | 100 | 98 | -2 | 3411190 | 123458 | 100 | 200 | +100 |
| 34156 (1010) | 4769066 | 234567 | 100 | 30 | -70 | 8790041 | 234568 | 100 | 150 | +50 | 9006544 | 234569 | 100 | 10 | -90 |

FIG. 10

1100

| | OUTCOME 1140 | SINGLE PLAYER 1150 | 2 MEMBER TEAM 1160 | 3 MEMBER TEAM 1170 |
|---|---|---|---|---|
| 1102 → | CHERRY/ANY/ANY | 2 | 1 | 1 |
| 1104 → | ANY/ANY/CHERRY | 2 | 1 | 1 |
| 1106 → | CHERRY/CHERRY/ANY | 5 | 3 | 1 |
| 1108 → | ANY/CHERRY/CHERRY | 5 | 3 | 1 |
| 1110 → | CHERRY/ANY/CHERRY | 5 | 3 | 2 |
| 1112 → | CHERRY/CHERRY/CHERRY | 20 | 10 | 5 |
| 1114 → | BAR/ORANGE/ORANGE | 10 | 5 | 2 |
| 1116 → | ORANGE/ORANGE/BAR | 10 | 5 | 2 |
| 1118 → | ORANGE/ORANGE/ORANGE | 20 | 10 | 5 |
| 1120 → | BAR/PLUM/PLUM | 14 | 6 | 3 |
| 1122 → | PLUM/PLUM/BAR | 14 | 6 | 3 |
| 1124 → | PLUM/PLUM/PLUM | 20 | 10 | 5 |
| 1126 → | BAR/BELL/BELL | 18 | 8 | 4 |
| 1128 → | BELL/BELL/BAR | 18 | 8 | 4 |
| 1130 → | BELL/BELL/BELL | 20 | 10 | 5 |
| 1132 → | BAR/BAR/BAR | 50 | 20 | 10 |
| 1134 → | 7/7/7 | 100 | 30 | 15 |

FIG. 11

1200

| | GAME RESULT 1240 | SINGLE PLAYER 1250 | 2 MEMBER TEAM 1260 | 3 MEMBER TEAM 1270 |
|---|---|---|---|---|
| 1202 → | CHERRY/ANY/ANY | 2 | 2 | 2 |
| 1204 → | ANY/ANY/CHERRY | 2 | 2 | 2 |
| 1206 → | CHERRY/CHERRY/ANY | 5 | 4 | 3 |
| 1208 → | ANY/CHERRY/CHERRY | 5 | 4 | 3 |
| 1210 → | CHERRY/ANY/CHERRY | 5 | 4 | 3 |
| 1212 → | CHERRY/CHERRY/CHERRY | 20 | 15 | 10 |
| 1214 → | BAR/ORANGE/ORANGE | 10 | 7 | 5 |
| 1216 → | ORANGE/ORANGE/BAR | 10 | 7 | 5 |
| 1218 → | ORANGE/ORANGE/ORANGE | 20 | 15 | 10 |
| 1220 → | BAR/PLUM/PLUM | 14 | 10 | 8 |
| 1222 → | PLUM/PLUM/BAR | 14 | 10 | 8 |
| 1224 → | PLUM/PLUM/PLUM | 20 | 15 | 10 |
| 1226 → | BAR/BELL/BELL | 18 | 15 | 10 |
| 1228 → | BELL/BELL/BAR | 18 | 15 | 10 |
| 1230 → | BELL/BELL/BELL | 20 | 15 | 10 |
| 1232 → | BAR/BAR/BAR | 50 | 30 | 20 |
| 1234 → | 7/7/7 | 100 | 75 | 50 |

FIG. 12

1300

| | OUTCOME 1340 | SINGLE PLAYER 1350 | | | 2 MEMBER TEAM 1360 | | | 3 MEMBER TEAM 1370 | | |
|---|---|---|---|---|---|---|---|---|---|---|
| | | 1ST REEL 1351 | 2ND REEL 1352 | 3RD REEL 1353 | 1ST REEL 1361 | 2ND REEL 1362 | 3RD REEL 1363 | 1ST REEL 1371 | 2ND REEL 1372 | 3RD REEL 1373 |
| 1305 | CHERRY | 20 | 50 | 20 | 10 | 40 | 10 | 5 | 30 | 5 |
| 1310 | ORANGE | 20 | 30 | 70 | 10 | 30 | 85 | 5 | 20 | 90 |
| 1315 | PLUM | 50 | 10 | 100 | 65 | 10 | 110 | 70 | 10 | 115 |
| 1320 | BELL | 100 | 20 | 10 | 120 | 25 | 5 | 130 | 30 | 2 |
| 1325 | BAR | 20 | 100 | 10 | 10 | 110 | 5 | 5 | 115 | 2 |
| 1330 | 7 | 10 | 10 | 10 | 5 | 5 | 5 | 2 | 2 | 2 |

FIG. 13

1400

| | OUTCOME 1440 | SINGLE PLAYER 1450 | | 2 MEMBER TEAM 1460 | | 3 MEMBER TEAM 1470 | |
|---|---|---|---|---|---|---|---|
| | | RANDOM NUMBER 1452 | EXPECTED HITS PER CYCLE 1454 | RANDOM NUMBER 1462 | EXPECTED HITS PER CYCLE 1464 | RANDOM NUMBER 1472 | EXPECTED HITS PER CYCLE 1474 |
| 1402 → | NONWINNING COMBINATION | 1-8570 | 8570 | 1-8917 | 8917 | 1-9289 | 9289 |
| 1404 → | CHERRY/ANY/ANY | 8571-9250 | 680 | 8918-9467 | 550 | 9290-9789 | 500 |
| 1406 → | ANY/ANY/CHERRY | 9251-9930 | 680 | 9468-10017 | 550 | 9790-10289 | 500 |
| 1408 → | CHERRY/CHERRY/ANY | 9931-10130 | 200 | 10018-10167 | 150 | 10290-10389 | 100 |
| 1410 → | ANY/CHERRY/CHERRY | 10131-10330 | 200 | 10168-10317 | 150 | 10390-10489 | 100 |
| 1412 → | CHERRY/ANY/CHERRY | 10331-10398 | 68 | 10318-10367 | 50 | 10490-10524 | 35 |
| 1414 → | CHERRY/CHERRY/CHERRY | 10399-10418 | 20 | 10368-104382 | 15 | 10525-10534 | 10 |
| 1416 → | BAR/ORANGE/ORANGE | 10419-10460 | 42 | 10383-10412 | 30 | 10535-10554 | 20 |
| 1418 → | ORANGE/ORANGE/BAR | 10461-10466 | 6 | 10413-10516 | 4 | 10555-10557 | 3 |
| 1420 → | ORANGE/ORANGE/ORANGE | 10467-10508 | 42 | 10517-10546 | 30 | 10558-10577 | 20 |
| 1422 → | BAR/PLUM/PLUM | 10509-10528 | 20 | 10547-10561 | 15 | 10578-10587 | 10 |
| 1424 → | PLUM/PLUM/BAR | 10529-10533 | 5 | 10562-10565 | 4 | 10588-10590 | 3 |
| 1426 → | PLUM/PLUM/PLUM | 10534-10583 | 50 | 10566-10600 | 35 | 10591-10615 | 25 |
| 1428 → | BAR/BELL/BELL | 10584-10587 | 4 | 10601-10603 | 3 | 10616-10617 | 2 |
| 1430 → | BELL/BELL/BAR | 10588-10607 | 20 | 10604-10618 | 15 | 10618-10627 | 10 |
| 1432 → | BELL/BELL/BELL | 10608-10627 | 20 | 10619-10633 | 15 | 10628-10637 | 10 |
| 1434 → | BAR/BAR/BAR | 10628-10647 | 20 | 10634-10647 | 15 | 10638-10647 | 10 |
| 1436 → | 7/7/7 | 10648 | 1 | 10648 | 1 | 10648 | 1 |

FIG. 14

1910

| | | | | | |
|---|---|---|---|---|---|
| PLAYER 1 LINE 1 1912 | CHERRY | BELL | ORANGE | BAR | CHERRY |
| PLAYER 1 LINE 2 1914 | BELL | PLUM | ORANGE | PLUM | ORANGE |
| PLAYER 1 LINE 3 1916 | 7 | BELL | PLUM | CHERRY | ORANGE |

1920

| | | | | | |
|---|---|---|---|---|---|
| PLAYER 2 LINE 1 1922 | BAR | PLUM | 7 | BAR | PLUM |
| PLAYER 2 LINE 2 1924 | CHERRY | CHERRY | BAR | CHERRY | BELL |
| PLAYER 2 LINE 3 1926 | PLUM | PLUM | ORANGE | BELL | ORANGE |

1930

| | | | | | |
|---|---|---|---|---|---|
| PLAYER 3 LINE 1 1932 | PLUM | SEVEN | BAR | ORANGE | CHERRY |
| PLAYER 3 LINE 2 1934 | BELL | PLUM | ORANGE | PLUM | ORANGE |
| PLAYER 3 LINE 3 1936 | BELL | BAR | CHERRY | CHERRY | BELL |

1940

| | | | | | |
|---|---|---|---|---|---|
| PLAYER 1 LINE 1 1942 | **CHERRY** | BELL | ORANGE | BAR | **CHERRY** |
| PLAYER 2 LINE 2 1944 | CHERRY | **CHERRY** | BAR | **CHERRY** | BELL |
| PLAYER 3 LINE 3 1946 | BELL | BAR | **CHERRY** | CHERRY | BELL |

FIG. 19

APPARATUS AND METHOD FOR FACILITATING TEAM PLAY OF SLOT MACHINES

CROSS-REFERENCE TO RELATED APPLICATIONS

This application is a continuation in part of U.S. patent application Ser. No. 10/067,576, now U.S. Pat. No. 6,712,699, incorporated herein by reference, filed on Feb. 6, 2002; which is a continuation-in-part of U.S. patent application Ser. No. 09/590,021, incorporated herein by reference, filed on Jun. 8, 2000 and issued as U.S. Pat. No. 6,361,441 on Mar. 26, 2002; which is a continuation of U.S. patent application Ser. No. 09/052,835, incorporated herein by reference, filed on Mar. 31, 1998 and issued as U.S. Pat. No. 6,142,872 on Nov. 7, 2000.

FIELD OF THE INVENTION

The present invention relates generally to electronic gaming devices, such as slot machines, and more particularly, to a system for facilitating team play of such electronic gaming devices.

BACKGROUND OF THE INVENTION

Gambling is a popular form of entertainment, offering gamblers many game alternatives, including numerous table games, such as poker, blackjack and roulette, and various electronic gaming devices, including slot machines, video poker devices, video keno devices and video blackjack devices (hereinafter, collectively referred to as "slot machines").

Golf is often played in a tournament environment where players compete against one another, with many golf tournaments incorporating a team component. The popular "better ball" golf tournament format, for example, permits the team score for each golf hole to be the lowest number of strokes obtained by any team player for a given hole. Another variation is the "best ball" format, where the best field position of any team player on each stroke is utilized by all team players for the subsequent stroke.

BRIEF DESCRIPTION OF THE DRAWINGS

FIG. 6 illustrates a sample table from the player database of FIG. 2;

FIG. 7 illustrates a sample table from the registered team database of FIG. 2;

FIG. 9 illustrates a sample table from the per-spin transaction database of FIG. 2;

FIG. 10 illustrates a sample table from the per-session transaction database of FIG. 2;

FIG. 11 illustrates a sample table from the per-spin payout database of FIG. 3;

FIG. 12 illustrates a sample table from the per-session payout database of FIG. 3;

FIG. 13 illustrates a sample table from the per-spin probability database of FIG. 3;

FIG. 14 illustrates a sample table from the per-session probability database of FIG. 3;

FIG. 19 illustrates exemplary views of outcomes generated by three different players, and a team outcome formed by combining the outcomes of the three players.

DETAILED DESCRIPTION

Figure 1:
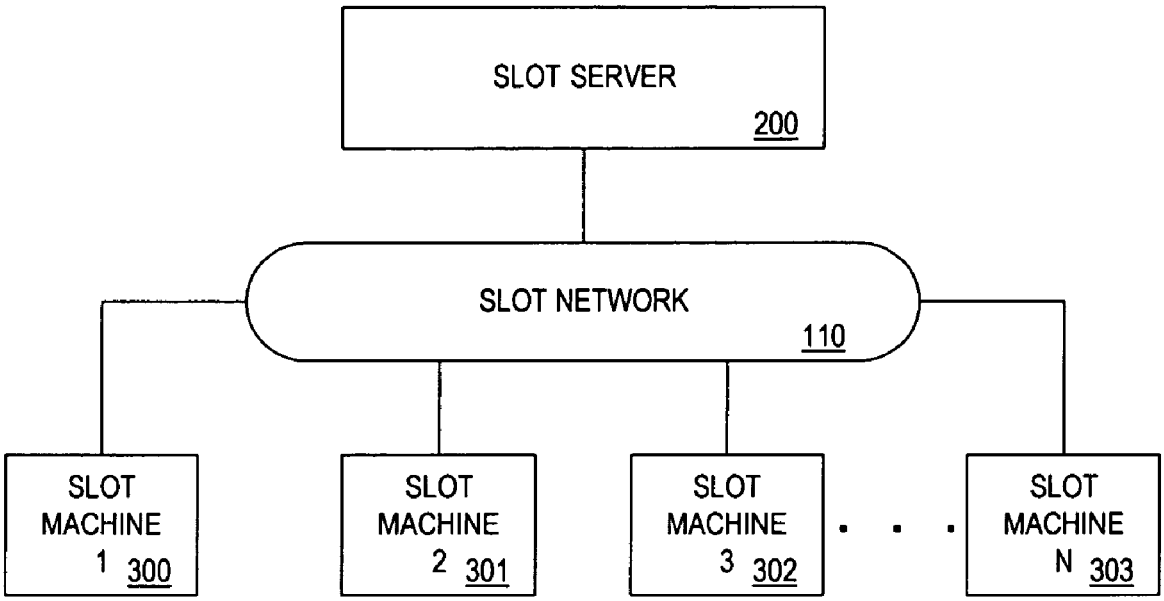
FIG. 1 is a schematic block diagram illustrating a suitable communications network environment for interconnecting one or more electronic gaming devices, such as slot machines, with a slot server.

In various embodiments, a team player may earn comp points for his team. For example, a team may earn a comp point for each handle pull made by a player on the team. A team may have an account for comp points, such that the account is not associated with a particular individual, but with the team as a whole. Thus, various embodiments contemplate an account for comp points that is associated with a group of people, such as a team, rather than with just a single individual. In various embodiments, an individual on a team may earn comp points for both himself and for his team. For example, for each handle pull made by a player, the player's team may earn one comp point and the player may also earn a comp point for his personal account.

There are many ways in which individual team players' results, and/or a team game result, may be indicated. According to various embodiments of the present invention, a display indicates a team result by bringing to prominence relevant indicia from the individual team players' results. These relevant indicia form the team result. Indicia may include reel symbols, card symbols, or numbers (e.g., from a video keno game, a video bingo game, or a video roulette game). According to various embodiments of the present invention, a display at a slot machine may bring indicia to prominence through means such as highlighting, flashing, underlining, or enlargement of the indicia.

Generally, according to various embodiments of the invention, a plurality of slot machines and a slot server enable team play of the slot machines by a plurality of slot machine players. The game results of each player on a given team are combined in a predefined manner to obtain a team game result. The game results of each player may be combined on a "per-spin" basis, or the game results may be collected for each team player over an entire play session, with the net result of each team player combined on a "per-session" basis.

In a "per-spin" embodiment, each team player initiates play (on the same or separate slot machines), and the individual game results of each team player are used in a predefined manner to obtain a team game result, with the team game result being the one that provides the highest resulting payout, for each spin. The individual game results of each team player can be combined by selecting the symbol obtained by the team players in each reel position that provides the team game result with the highest resulting payout. Alternatively, the individual game result of the team player providing the highest resulting payout can be selected as the team game result. Alternatively, the team game result is not the highest resulting payout (e.g., is the second-highest resulting payout).

In a "per-session" embodiment, each team player continues play for an entire play session, and the net result of each team player is analyzed in a predefined manner on a "per-session" basis to obtain the team session result. A session can be defined, for example, in terms of (i) the number of plays per session; (ii) the duration of the session; or (iii) the number of plays until a predefined event occurs. The team session result can be defined, for example, as (i) the highest individual net result of a team player after an entire session; (ii) the average of the net result of each team player after an entire session; (iii) the sum of the highest five payouts awarded to any team player during the session; or (iv) the sum of each of the highest payouts for each spin. Alternatively, the team session result is not a highest resulting payout (e.g., is the second-highest resulting payout). Also, the team session result need not be based on a highest payout (or payouts). For example, the team session result can be defined as (i) the second highest individual net result of a team player after an entire session; or (ii) the sum of any predetermined combination of payouts awarded to any team player during the session (or for each spin).

FIG. 1 shows an illustrative slot network 110 for transferring information between one or more slot machines 300-303 and a slot server 200. According to a feature of the present invention, the slot server 200 permits team play of slot machines by a plurality of slot machine players using the slot machines 300-303. The game results of each player on a given team are combined in a predefined manner, and the overall game result (e.g., one that provides the highest payout) is provided to each of the team members.

According to a further feature of the invention, the game results of each player on a given team may be combined in a predefined manner on a "per-spin" basis. The game results may also be collected for each team player over an entire play session, with the net result of each team player analyzed in a predefined manner on a "per-session" basis. In this manner, team players are encouraged to support and cheer on one another and may compete against other teams. Thus, according to these and other various embodiments of the present invention, the social and competitive aspects of slot machine play may be increased. In addition, the potential loss to each team player is minimized, since a non-winning per-spin or per-session game result by a team player can be offset when combined with the corresponding winning results of another team member.

As used herein, the term "slot machine" refers to any programmable gaming device generating a random or pseudo-random event in which one or more players can wager on the outcome of the event. Examples of slot machines include traditional slot machines, video poker, video bingo, video keno and video blackjack devices.

Team Registration

Teams may be formed by individual slot machine players or by a casino, for example, on an anonymous ad hoc basis. Players can optionally register for team play with a casino, for example, by providing the names and player tracking numbers of team players and the preferences of the team, such as whether per-spin or per-session team play is preferred, and the preferred length of each session for per-session play. Team players can be linked electronically, for example, by means of player tracking cards. Thus, the slot server 200 can recognize players as members of a team once the player tracking card of each team member has been inserted into a card reader on the slot machine 300-303. The presence of all team members may or may not be required to initiate team play. Slot server 200 can indicate to a team player whether other team members are currently playing a slot machine 300-303, such as a representative slot machine 300, in the casino.

The formation of a team may begin when one or more of the prospective members communicates to the slot server 200 the desire to form a team. Team members may communicate with the slot server 200 via a gaming device, such as slot machine 300, with a network connection to the server. Team members may come to an information or chip-cashing desk at a casino and inform a casino employee of the desire to register a team. The casino employee may then communicate with the slot server 200 on the team's behalf. A team may also register on-line. For example, one or more team members may use a personal computer to access a Web site hosted by a slot server 200. The team member(s) may then provide registration information by keying it into dialog boxes on the Web site, by selecting relevant options from menus, and so on. A team may also register over the phone, via email, or via any other method, such as a form displayed at a display of a slot machine 300, or on a Web page hosted by the slot server 200.

A casino may prompt prospective team members as to whether or not they wish to join a team. For example, a slot server 200 may transmit a message via the casino's slot network to prospective members' slot machines. A slot machine 300 that has received such a message may then display it on a display of the slot machine 300. Alternatively, the slot machine 300 may output an audio message to the user at the slot machine 300. The user may then respond by touching areas on a display, by keying in a response using a keypad or other buttons, or by voicing a response into a microphone of the slot machine 300.

Per-Spin Embodiment

Generally, in a "per-spin" embodiment of the present invention, each team player initiates play in a conventional manner, and the individual game results of each team player are combined in a predefined manner to obtain the team game result, with the team game result being the one that provides the highest resulting payout, for each spin. In the illustrative implementation of the per-spin embodiment discussed herein, the individual game results of each team player are combined by selecting the symbol obtained by the team players in each reel position that provides the team game result with the highest resulting payout. In an alternate implementation, the individual game result of the team player providing the highest resulting payout can be selected as the team game result.

For example, three team players, Jack, Mary and Bob commence per-spin team play on three compatible slot machines 300-303, such as three-reel slot machines. Once the team players initiate play at their respective slot machines, the following individual game results and team game result may occur (assuming the team game result is obtained by selecting one symbol from each reel position that provides the best team game result):

| | REEL 1 | REEL 2 | REEL 3 | CORRESPONDING PAYOUT FOR CONVENTIONAL VERSUS TEAM RESULTS |
|---|---|---|---|---|
| JACK | BELL | ORANGE | BELL | 0 |
| MARY | CHERRY | BAR | CHERRY | 5 COINS |
| BOB | BAR | CHERRY | BELL | 0 |
| TEAM GAME RESULT | CHERRY | CHERRY | CHERRY | 5 COINS PER TEAM PLAYER |

If each of the team players in the above example had been playing on conventional slot machines, only Mary would have been a winner of five coins. As per-spin team players, however, each of the team players is awarded five coins for the "best team game result" of "cherry/cherry/cherry," based on the payout awards provided in the per-spin payout database 1100, discussed further below in conjunction with FIG. 11. As discussed further below, in conjunction with FIGS. 3, 4A and 4B, in the per-spin embodiment, the slot machine 300 may optionally include a display indicating the individual game result of each team player after each spin of the slot machine 300, as well as the combined team game result. In this manner, the interactive aspects of team play are reinforced to team players, and team players can ensure that the best team game result has been selected for each spin.

In one implementation of the per-spin embodiment, each team player must wait for all other players on the same team to complete their spin before obtaining the team game result. A "waiting" message can be presented next to the names of the team players that have not completed their spin. In a further variation, individual team players can continue individual play while waiting for the team results.

In various per-spin embodiments, members of a team may jointly participate in determining a single outcome. In one exemplary embodiment, a 3×3 grid of opaque symbols is visible on the display screens of each of two team members. Behind each opaque symbol is hidden a game symbol, such as "bar," "bell," or "plum." The hidden symbols are the same for both team members. In fact, the displays on the two team members' screens are just different displays of the same game. The rows of the grid are numbered "1," "2," and "3," while the columns of the grid are labeled "A," "B," "C." To play the game, the team members must select a grid location such as "A1" or "B3" by selecting both a row and a column. The hidden symbol behind the opaque symbol for that grid location will then be revealed. According to various embodiments, the grid location is selected by having one of the two team members select a row, and by having the other of the two team members select a column. Once both a row and a column have been selected, the gaming devices of the two team members reveal the corresponding hidden symbol. The symbol may then result in a payout for the two team members. The payout may be received at either one of, or at both of the team members' gaming devices. In this way, both team members have contributed to the selection of an outcome. It will be appreciated that the present embodiment may be extended to grids of any number of rows or columns, and indeed to three or higher-dimensional grids. Play of a three-dimensional grid may, for example, involve the inputs of three team members.

In another exemplary embodiment, each of two or more team members may submit a seed number to be used in a random number generator for determining an outcome. As is well known in the art, many gaming devices determine an outcome by first generating one or more random numbers and then matching those numbers to a corresponding outcome. Seed numbers may be used as a way of initializing random number generators. In the various embodiments, seeds submitted by two or more team members may be combined (e.g., added or multiplied) and then used as the basis for generating an outcome-determining random number. In this way, team members may jointly contribute to the generation of an outcome. The seed provided by one or more team members need not be provided explicitly. For example, a team member need not submit a sequence of numerical digits. Rather a seed may be derived from a digital representation of a team player's fingerprint, from a measurement of the time during which a team player presses one or more buttons, and so on.

Per-Session Embodiment

Generally, in a "per-session" embodiment of the present invention, each team player continues play in a conventional manner for an entire play session, and then the net result of each team player can be analyzed in a predefined manner on a "per-session" basis to obtain the team session result. A session can be defined, for example, in terms of (i) the number of plays per session, such as 100 plays of the slot machine; (ii) the duration of the session, such as one hour; or (iii) the number of plays until a predefined event occurs, such as a particular game result (e.g., one team player hits "cherry/cherry/cherry").

As discussed further below, the slot server 200 monitors the game results of each team player for the duration of the session, and then awards the team session result to each team player after the session is complete. In the illustrative implementation of the per-session embodiment discussed herein, the highest individual net result of a team player after an entire session is selected as the team session result. In alternate implementations, the team session result can be defined as (i) the average of the net result of each team player after an entire session; (ii) the sum of the highest five (or highest x, where x could be any number) payouts awarded to any team player during the session; (iii) the sum of each of the highest payouts for each spin; or (iv) the sum of all payouts for a given game result, such as a predefined game result, the most frequently occurring game result, the game result providing the highest payout over an entire session, or the game result providing the lowest positive payout; (v) the sum of each team player's highest three (or highest x) payouts; (vi) the sum of net results of each team at the point in time during the session when the sum was the highest; (vii) the average of the net results of the single best performing team player and the single worst performing team player; (viii) the negative of any of the above, e.g. the negative of the average net results each team player; or (ix) the sum of the first, third, and fifth highest payouts for each spin.

For example, three team players, Jack, Mary and Bob commence per-session team play on three of compatible slot machines 300-303, such as three-reel slot machines, and continue for an entire session of 100 plays. A compatible slot machine may be defined, for example, as a slot machine having the same manufacturer and model number. Once each of the team players completes the session at their respective slot machines, the following individual net results and team session result may occur (assuming the team session result is obtained by selecting the highest individual net result):

| | PLAYER WIN/LOSS |
|---|---|
| JACK | +20 |
| MARY | −2 |
| BOB | +100 |
| TEAM SESSION RESULT | +100 |

Once the session is complete, the slot server 200 determines that the highest individual net result is +100. Since each player inserted 100 coins to complete the 100 play session, the slot server 200 then instructs the respective slot machines to dispense 200 coins to each team player to obtain the desired team session result of 100 coins (a profit of 100 coins for each player). If each of the individual team members obtains a negative net result, the slot server 200 selects the best negative net result as the team session result and instructs the respective slot machines to dispense the appropriate amount of coins to each team player that results in each player obtaining a minimum loss equal to the team session result. Thus, according to this and other various embodiments of the present invention, the financial risk associated with slot machine play may be spread among a plurality of players.

As discussed further below, in conjunction with FIGS. 3, 5A, 5B, 5C and 5D, in the per-session embodiment, the slot machine 300 may optionally include a display indicating the current net result of each team player, as well as the current team session result. In this manner, the interactive aspects of team play are reinforced to team players and team players can ensure that the correct team session result has been selected for the session. Alternatively, the individual net results and team session results may be displayed only upon completion of a session.

In one implementation of the per-session embodiment, each team player could be required to play a session simultaneously. In an alternate implementation, team players could play at separate times, and the team session result can be calculated once each team player has completed the session. A "waiting" message can be presented next to the names of the team players that have not completed their session. Preferably, no coins are paid out until the session is complete.

The slot server 200 and the slot machines 300-303, discussed further below in conjunction with FIGS. 2 and 3, respectively, may be embodied as conventional hardware and software, as modified herein to carry out the functions and operations described below. The slot server 200 and slot machines 300-303 transmit data between one another. The transmitted data may represent player names and corresponding identification numbers and team associations, credit balance amounts and play results. Of course, other types of data may also be transmitted. The slot server 200 and each of the slot machines 300-303 may communicate by means of cable and/or wireless links on which data signals can propagate.

Figure 2:
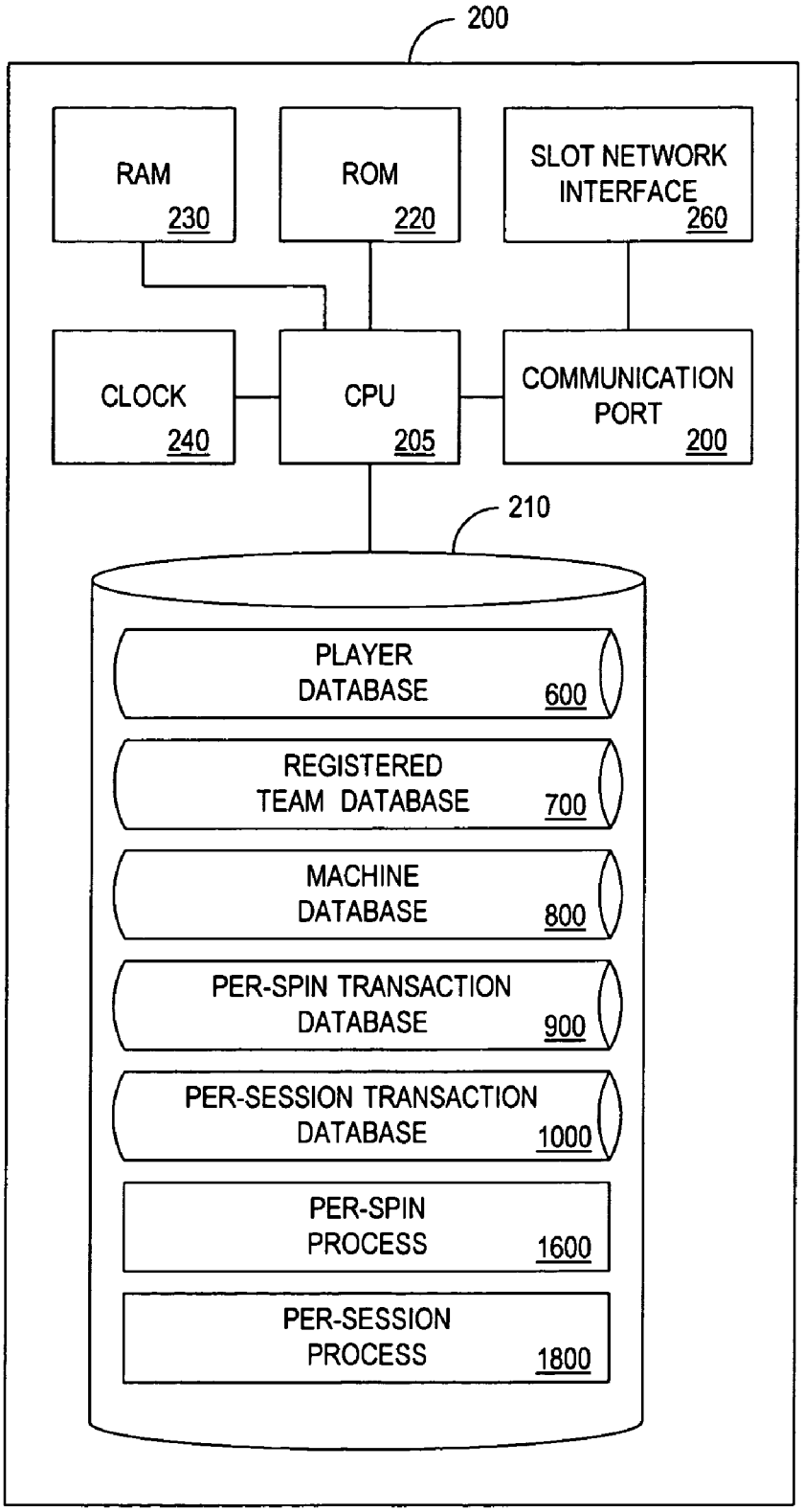
FIG. 2 is a schematic block diagram of the slot server of FIG. 1.

FIG. 2 is a block diagram showing the architecture of an illustrative slot server 200. The slot server 200 may be embodied, for example, as an RS 6000 server, manufactured by IBM Corp., as modified herein to execute the functions and operations of the present invention. The slot server 200 includes known hardware components, such as a central processing unit (CPU) 205 in communication with each of a data storage device 210, a read only memory (ROM) 220, a random access memory (RAM) 230, a clock 240, a communications port 250 and a slot network interface 260. The CPU 205 can be in communication with the data storage device 210, the read only memory (ROM) 220, the random access memory (RAM) 230, the clock 240, the communications port 250 and the slot network interface 260, either by means of a shared data bus, or dedicated connections, as shown in FIG. 2. The CPU 205 may be embodied as a single processor, or a number of processors.

As discussed further below in conjunction with FIGS. 6 through 10, the data storage device 210 includes a player database 600, a registered team database 700, a machine database 800, a per-spin transaction database 900 and a per-session transaction database 1000. The player database 600 stores information on each player, including an identifier of each player's team and the player's loyalty reward points balance. According to various embodiments, a player may be on more than one team. Player database 600 may thus include an identifier for each team of which the player is a member. The registered team database 700 stores information on each team that is registered for slot machine play, including an identification of each team member. The machine database 800 stores information on each slot machine in a casino, including the type of each machine. The stored machine information may be used, for example, to ensure that each team player is utilizing one of compatible slot machines 300-303. The per-spin transaction database 900 stores play results for each team playing in a per-spin embodiment of the present invention. The per-session transaction database 1000 stores play results for each team playing in a per-session embodiment of the present invention.

The data storage device 210 and/or ROM 220 are operable to store one or more instructions, which the CPU 205 is operable to retrieve, interpret and execute. As shown in FIG. 2 and discussed further below in conjunction with FIGS. 16 and 18, the data storage device 210 includes a per-spin process 1600 and a per-session process 1800, to implement the two illustrative embodiments of the present invention. As discussed below, the per-spin process 1600 and the per-session process 1800 are each executed in cooperation with similar processes 1500, 1700, respectively. These processes 1500, 1700 are executed on the individual slot machines 300-303 being utilized by team members.

The communications port 250 connects the slot server 200 to a slot machine interface 260, thereby permitting the slot server 200 to communicate with each connected slot machine, such as the slot machines 300-303 shown in FIG. 1. The communication port 250 may include multiple communication channels for simultaneous connections. It is noted that the functionality provided by the slot server 200, such as providing each slot machine 300-303 with team information and coordinating team play, could be provided directly by one or more of the slot machines 300-303 or by a separate team controller (not shown), as would be apparent to a person of ordinary skill in the art.

Figure 3:
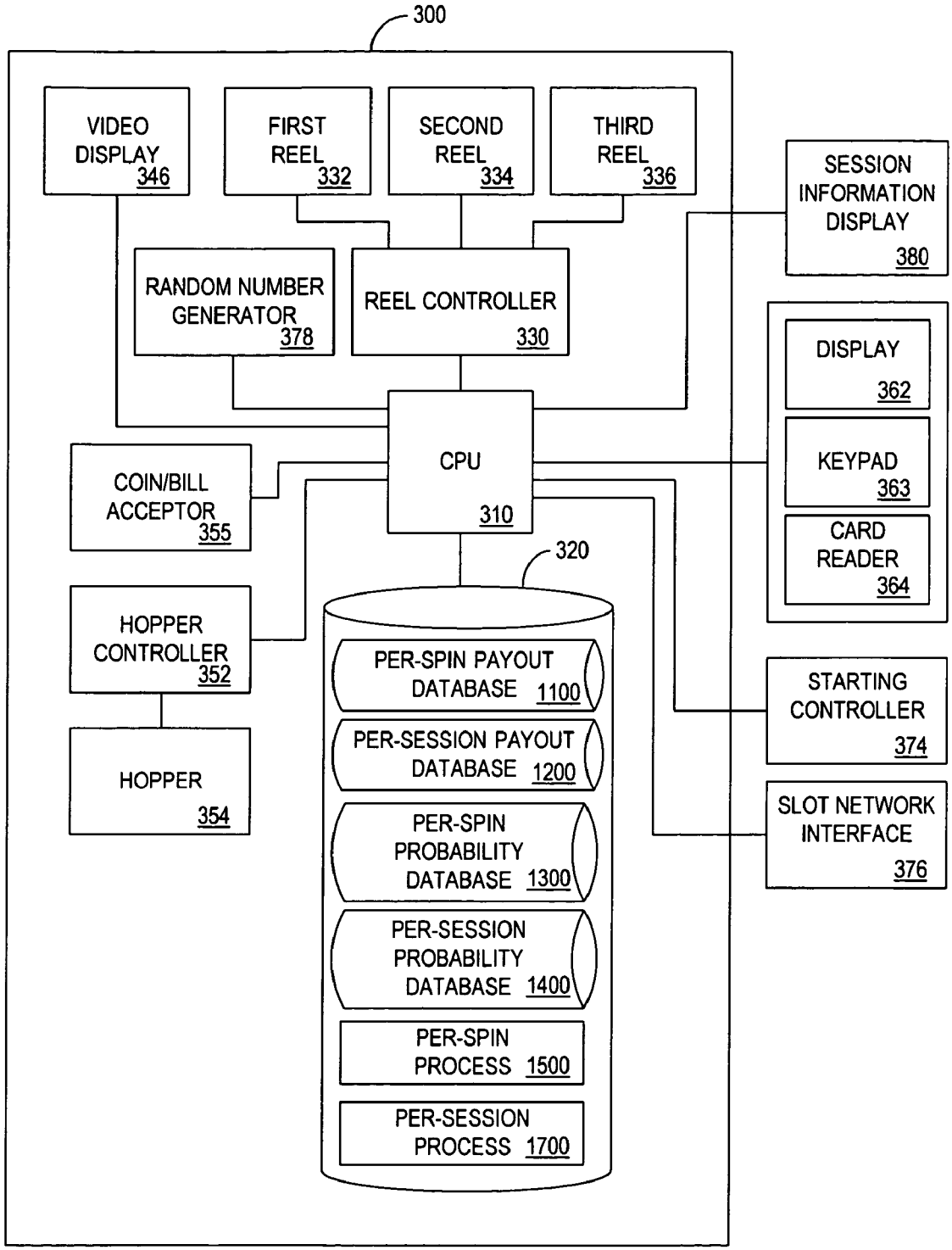
FIG. 3 is a schematic block diagram of a slot machine of FIG. 1, in accordance with the present invention.

FIG. 3 is a block diagram showing the architecture of an illustrative slot machine 300. Although descriptions herein of various embodiments of the present invention may refer for convenience to slot machine 300, it will be understood that such descriptions may apply to any of slot machines 300-303. The architecture illustrated in FIG. 3 is also descriptive of the functionality of the slot machines 301-303 shown in FIG. 1. Plan views of various per-spin and per-session embodiments of the slot machine 300 are shown in FIGS. 4A, 4B, 5A, 5B, 5C and 5D. The slot machine 300 includes known hardware components, such as a CPU 310 and a data storage device 320, which may function in a similar manner to those corresponding components described above in conjunction with FIG. 2.

As previously indicated, the present invention permits team play of slot machines on a "per-spin" or "per-session" basis. In one implementation, each slot machine 300 maintains separate databases for storing the probability that a given game result will occur, and the corresponding payout associated with each winning game result, for a number of team sizes, for each of the "per-spin" and "per-session" embodiments. Thus, as discussed further below in conjunction with FIGS. 11 through 14, respectively, the data storage device 320 includes a per-spin payout database 1100, a per-session payout database 1200, a per-spin probability database 1300 and a per-session probability database 1400. Generally, the per-spin payout database 1100 and the per-session payout database 1200 store the payouts associated with each winning game result for a number of team sizes, for the per-spin and per-session embodiments, respectively.

Likewise, the per-spin probability database 1300 and the per-session probability database 1400 store the probability that a given game result will occur for a number of team sizes, for the per-spin and per-session embodiments, respectively. The respective payout databases 1100, 1200 or the probability databases 1300, 1400, for each of the "per-spin" and "per-session" embodiments, can be adjusted in accordance with the present invention to fund team play. Alternatively, both the respective payout databases 1100, 1200 and the probability databases 1300, 1400, for each of the "per-spin" and "per-session" embodiments, can be adjusted to fund team play. For a more detailed discussion of a conventional slot machine, and the associated probabilities and payouts, see J. Regan, Winning at Slot Machines (Citadel Press 1985), incorporated by reference herein.

In addition, the data storage device 320 and/or ROM (not shown) are operable to store one or more instructions, which the CPU 310 is operable to retrieve, interpret and execute. As shown in FIG. 3 and discussed further below in conjunction with FIGS. 15 and 17, the data storage device 320 includes a per-spin process 1500 and a per-session process 1700, to implement the "per-spin" and "per-session" embodiments of the present invention. As previously indicated, the per-spin process 1500 and the per-session process 1700 are executed by the slot machines 300-303 being utilized by team players, in cooperation with similar processes 1600, 1800, respectively, executing on the slot server 200 to coordinate team play.

In a per-spin embodiment, each player starts the representative slot machine 300 in a conventional manner by providing a form of payment, for example, by depositing one or more coins or bills in a coin/bill acceptor 355, or inserting a credit card, debit card or smart card into a card reader 364. If the player inserts a player tracking card, the slot machine 300 will determine if the player is registered with a team. Alternatively, a player may indicate he is registered with a team by other means, such as via a button or keyboard input. If the player is not registered with a team, the player can play the slot machine 300 in a conventional manner.

If the player is registered with a team, however, and agrees to participate in team play while one or more of the player's teammates are currently playing, team play can be enabled. Each team player then initiates play by pressing a starting controller 374, such as a "spin reels" button on their respective slot machine 300-303. Thereafter, the CPU 310 on each respective slot machine 300-303 initiates the random number generator 378 to generate a random number. The CPU 310 looks up the generated random number in the appropriate field of the appropriate probability database per-spin probability database 1300, discussed below in conjunction with FIG. 13, and based on the number of team players currently playing retrieves the corresponding reel combination, or individual game result. Each CPU 310 also directs a reel controller 330 to spin the reels 332, 334, 336 and to stop them at a point when a combination of symbols corresponding to the retrieved individual game result is displayed. In alternative embodiments, the slot machine 300 does not include the reel controller 330, or reels 332, 334, 336. Instead, a video display area 346 graphically displays representations of objects contained in the selected game, such as graphical reels or playing cards. These representations are preferably animated to simulate playing of the selected game.

Figure 4A:
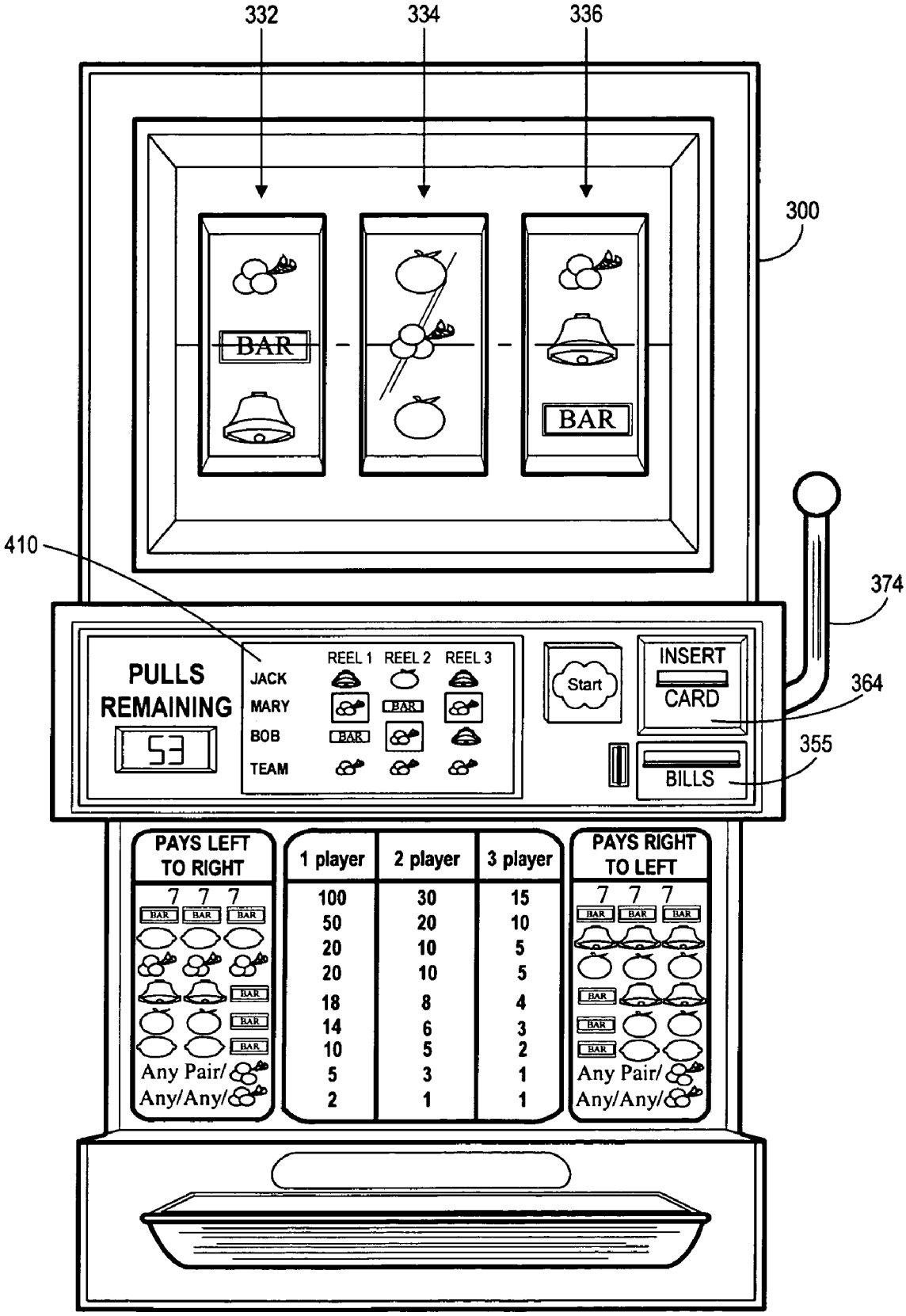
FIGS. 4A, 4B, 5A, 5B, 5C and 5D are plan views of various embodiments of the slot machine of FIG. 3.

The individual game result of each team player is then transmitted to the slot server 200, which generates the resulting team game result in a predefined manner. The slot server 200 then transmits the individual game results and resulting team session result to each slot machine 300-303, for display to each team player on a display. According to various embodiments of the present invention, slot machine 300 brings to prominence indicia from individual team players' results by displaying the indicia in an area of video display 346 of slot machine 300. Alternatively, as described with respect to various embodiments herein, indicia and/or results may be displayed at a display of slot machine 300 other than video display 346, such as display 410 (FIG. 4A).

There are many ways in which a display may indicate individual team players' results and/or the team game result. In one embodiment, a display of slot machine 300 indicates the team result by bringing to prominence relevant indicia from the individual team players' results. These relevant indicia are combined in a predefined manner to form the team result. Indicia may include reel symbols, such as "orange", "cherry" or "7". Indicia may also include card symbols, such the king of spades, three of diamonds, or a joker. Indicia may further include numbers from a video keno game, a video bingo game, or a video roulette game.

In another embodiment, a slot machine 300 brings to prominence indicia from individual team players' results by displaying the indicia at a display of the slot machine 300. A display (e.g., video display area 346) of slot machine 300 may highlight, call attention to, or otherwise bring indicia to prominence through the use of highlighting, flashing, underlining, enlargement, or other means known to those of skill in the art.

For example, suppose Linda and Sue comprise a two-person team. In one example of a video poker embodiment, Linda and Sue are on separate video draw poker machines. Each begins with a five-card hand, discards from one to five cards, and receives replacement cards. The team result for Linda and Sue may be defined, for example, as the best five-card poker hand that can be made by combining at least one card from Linda's hand with at least one card from Sue's hand. Of course, the team result may be defined as various other combinations of Linda's hand and Sue's hand. For example, a team result need not require at least one card from each player's hand.

Once Linda and Sue have each completed individual games, the slot server 200 receives Sue's individual game result and transmits it to Linda's slot machine, and receives Linda's individual game result and transmits it to Sue's slot machine. Then, Linda's slot machine displays Linda's five-card hand in one row, and Sue's five-card hand in a second row. The slot machine then highlights the five cards from the two hands that will make the team result. For instance if Linda's hand is As Qs 9d 5h 3c, and Sue's hand is Ks Js 10s 8c 6c (where "A"=ace, "K"=king, "Q"=queen, "J"=jack, "s"=spades, "h"=hearts, "d"=diamonds, "c"=clubs) then the As Qs from Linda's hand combines with the Ks Js 10s from Sue's hand to make a team outcome of As Ks Qs Is 10s, or a royal-straight-flush. In this example, Linda's slot machine may therefore highlight the As and Qs from Linda's hand, and the Ks Js 10s from Sue's hand, so as to indicate the cards that are to be used in the team result.

FIG. 4A illustrates another example of bringing to prominence individual indicia from different team players' results so as to indicate a team result. In FIG. 4A, outcomes for three team players are displayed at display 410. Team player Jack has obtained the outcome bell-orange-bell. Team player Mary has obtained the outcome cherry-bar-cherry. Team player Bob has obtained the outcome bar-cherry-bell. In FIG. 4A at display 410, a line is drawn around each of the cherry indicia, forming a separate box around each cherry indicium. In this way, each team player can see that the two cherries from Mary's outcome, and the cherry from Bob's outcome, have contributed to the overall team outcome of cherry-cherry-cherry. Of course, alternatively or in addition, the indicia and results could be displayed at video display 346.

A display (e.g., display 410) on a slot machine 300 may also rearrange indicia in order to indicate a team result. For instance, in the above example, Linda's slot machine may initially display Linda and Sue's individual results as hands in two separate rows. The display 410 may then show the cards being switched between the two rows until the team result is in the top row, and the cards not used from Linda and Sue's hands are displayed in the bottom row. In many embodiments, the rearrangement is performed slowly so that a user can easily see a card from one row traveling to the other, and being replaced by another card from the other row. Furthermore, the slot machine may repeatedly illustrate the rearrangement of cards, in case the user had not been paying attention. For example, display 410 may begin by showing Linda's hand in row one and Sue's hand in row two, and may then rearrange the cards to show As Ks Qs Js 10s in row one and 9d 5h 3c 8c 6c in row two. However, slot machine 300 may then revert to showing Linda's hand in row one and Sue's hand in row two, and repeat the rearrangement. The process may repeat until, for example, Linda and Sue begin a new game. Of course, a slot machine 300 may illustrate the rearrangement of any other type of indicia between two or more individual results in order to display a team result.

In another embodiment, a slot machine 300 brings to prominence indicia from individual team players' results by displaying the indicia in a special area on a video display of the slot machine 300 (e.g., video display 346), or other display. Once again using the example of Linda and Sue, Linda's slot machine may display both Linda and Sue's individual results on the lower part of the screen. However, in the upper half of the screen, Linda's slot machine may display the team result consisting of only the five cards As Ks Qs Js 10s. With these five cards at the top of Linda's video display, the same cards may or may not be removed or blanked out from Linda and Sue's hands displayed at the bottom. In some embodiments, Linda and Sue's individual results are first displayed at the bottom of the slot machine. From there, the display shows the individual cards to be displayed moving upwards towards the top of the screen where they are arranged into the team result. The cards that move to the top may be the originals that thereupon leave Linda and Sue's individual results.

Alternatively, the cards moving to the top of the display may be duplicates, or may otherwise represent the cards from the individual results that are being used to form a team result. For example, the cards in motion may be duplicates, or faded, highlighted, flashing, alternatively-colored, differently-sized, or differently-shaped representations of the indicia from the individual results. For example, a card Ks in an individual result may be represented by a chess piece, advancing to the top of the screen, and bearing the marks of a Ks. The motion of cards or other indicia, from a display of individual results to a display of a team result, makes it clear to a team player how a team result is formed from individual results.

Figure 4B:
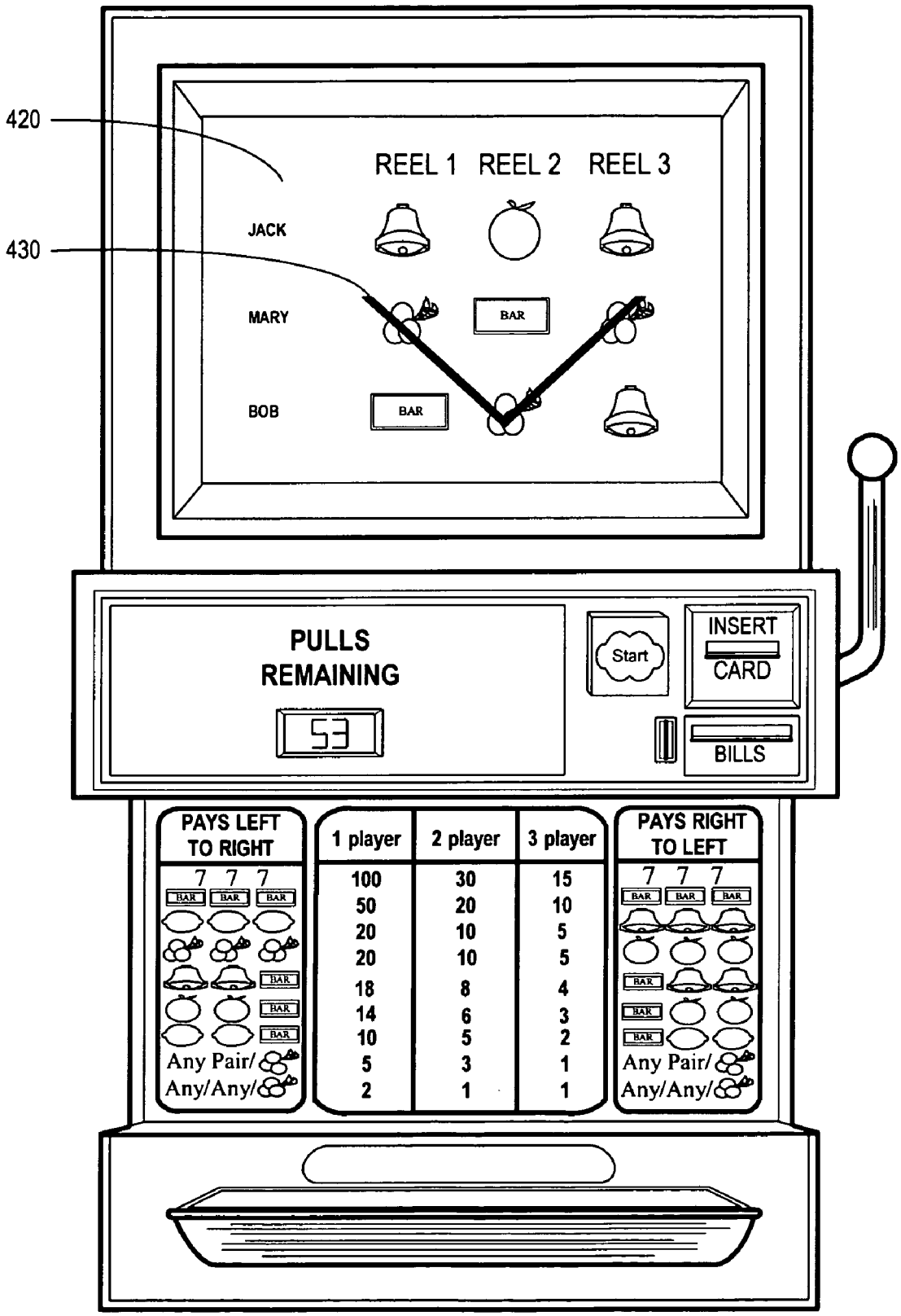

In another embodiment, a slot machine 300 displays multiple results from individual team players in proximity to one another. For example, the team of Jack, Mary, and Bob, obtain the outcomes of bell-orange-bell, cherry-bar-cherry, and bar-cherry-bell, respectively. When the three individual results are combined into a team result, the three outcomes are displayed right above one another, as illustrated in FIG. 4B at display 420. A line 430 is drawn through the indicia that are to form the team result. So, for example, the line 430 is drawn going through the first cherry of Mary's outcome, continuing through the cherry of Bob's outcome, and continuing through the second cherry of Mary's outcome. It is therefore evident to the team players that the three indicia through which the line is drawn comprise the team outcome of cherry-cherry-cherry. Other means of showing the grouping of indicia from different team players' outcomes are also possible. For example, a line may be drawn that encircles only the two cherries from Mary's outcome and the cherry from Bob's outcome.

In one embodiment, the slot machine uses a puzzle metaphor to show how different player outcomes combine to form a team outcome. After each team player's individual outcome has been generated, and the slot server 200, or one of the slot machines 300-303, has determined the team outcome, then a team player's slot machine 300 may begin by displaying the team outcome in faded color(s). For instance, the slot machine 300 may display the team outcome of bell-bell-bell by showing three bell indicia in faded colors. Then, the slot machine 300 shows a bell indicium being taken from a team player's outcome and being overlaid on top of one of the faded bells. Then another bell indicium from a team player's outcome is taken and overlaid on top of another of the faded bells. In this manner, players can visually see what the team outcome is going to look like, and can see how pieces of the "puzzle" are taken from individual team players' outcomes and put in place to form the team outcome.

In other puzzle embodiments, individual indicium take the form of shapes or structures. A team outcome can be displayed from among individual team player indicia by showing such indicia coming together in such a way as to complement each other in shape or structure. For example, one team player obtains an indicium in the shape of an incomplete circle (e.g., with a wedge-shaped space in the circle, or with a break in the circumference of the circle). Another player obtains an indicium having a complementary shape (e.g., the shape of the wedge-shaped space). The team result is formed by combining the indicia of the players (e.g., aligning the incomplete circle and the wedge) into a complete circle.

In some embodiments, the combination of game results from different team players may result in outcomes that are not attainable by a player on his own. For example, two hands of video poker, one containing three aces, and one containing two aces, may be combined to form a hand with five aces. It would be impossible for a player using a single ordinary deck to achieve a hand with five aces. Another hand of video poker attainable through the combination of individual hands, but not in an individual hand, would be a two-pair/flush. A team may receive bonus payouts for achieving combinations not attainable by an individual player or by individual team members.

Based on the identified team result, each slot machine 300-303 stores the payout credits, if any, in a random access memory (RAM) (not shown). A hopper controller 352 is connected to a hopper 354 for dispensing coins. Each team player can cash out in a conventional manner by pushing a cash out button 370 on his or her respective slot machine 300-303. The CPU 310 then checks the RAM to see if the player has any credit and, if so, signals the hopper 354 to release an appropriate number of coins into a payout tray (not shown).

In a per-session embodiment, each team player starts his or her representative slot machine 300-303 in a conventional manner. If a player inserts a player tracking card, the slot machine 300 will determine if the player is registered with a team. If the player is not registered with a team, the player can play the slot machine 300 in a conventional manner. If the player is registered with a team, however, and agrees to participate in team play while one or more of the player's teammates are currently playing, each team player continues play in a conventional manner for an entire play session, in the manner described above. Once the session is complete, each slot machine 300-303 being utilized by a team player can signal the slot server 200 with each player's net result. The slot server 200 combines the net result of each team player in a predefined manner on a "per-session" basis to obtain a team session result.

Figure 5A:
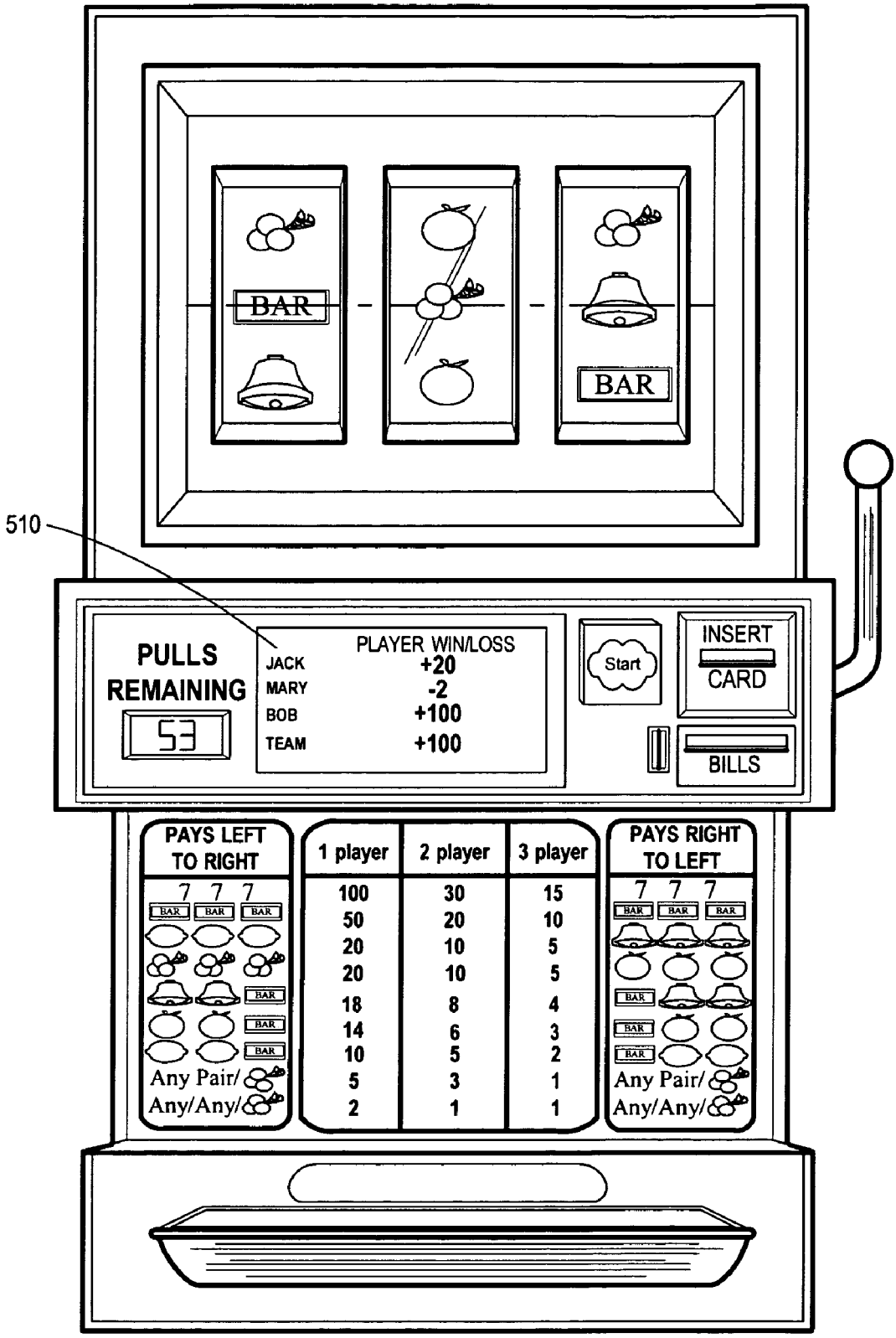

The slot server 200 then transmits the individual net results of each team player and the resulting team session result to each slot machine 300-303, for display to each team player on a display. According to various embodiments of the present invention, the individual net results of each team player and the team session result may be displayed in an area of video display 346 of slot machine 300. Alternatively, as described with respect to various embodiments herein, player and/or team results may be displayed at a display of slot machine 300 other than video display 346, such as display 510 (FIG. 5A).

In many embodiments described herein, the highest result among team players' individual results becomes the team result. For example, the highest payout among the team players on a given spin becomes the team result. The individual player results may thus be appropriately illustrated graphically so as to make it visually evident which team player has obtained the highest result. For example, each team player's name is listed horizontally along the axis of a bar graph. The bar corresponding to each player's name then illustrates the payout for the outcome achieved by that player for the current spin. By looking at the bar graph, it becomes evident which player has achieved the highest payout, because the bar corresponding to that player extends above all of the other bars. In some embodiments, once all team players' individual results have been graphically illustrated on the bar graph, the name and/or the bar of the player who has achieved the highest payout on the spin is made prominent, so that it is even more clear which player's individual result has become the team result. A bar graph may further be used to illustrate individual team players' net or gross session results.

In some embodiments, sorting is used to illustrate a team result that is the highest from among individual player results. For instance, the names of three team players are listed in a column on a display of a slot machine 300. Once each team player has made his spin, the payout for each team player's outcome is posted next to the corresponding team player's name. Then, the team players' names are rearranged in the column on the screen, so that the name of the team player with the highest payout is now at the top of the column.

Figure 5B:
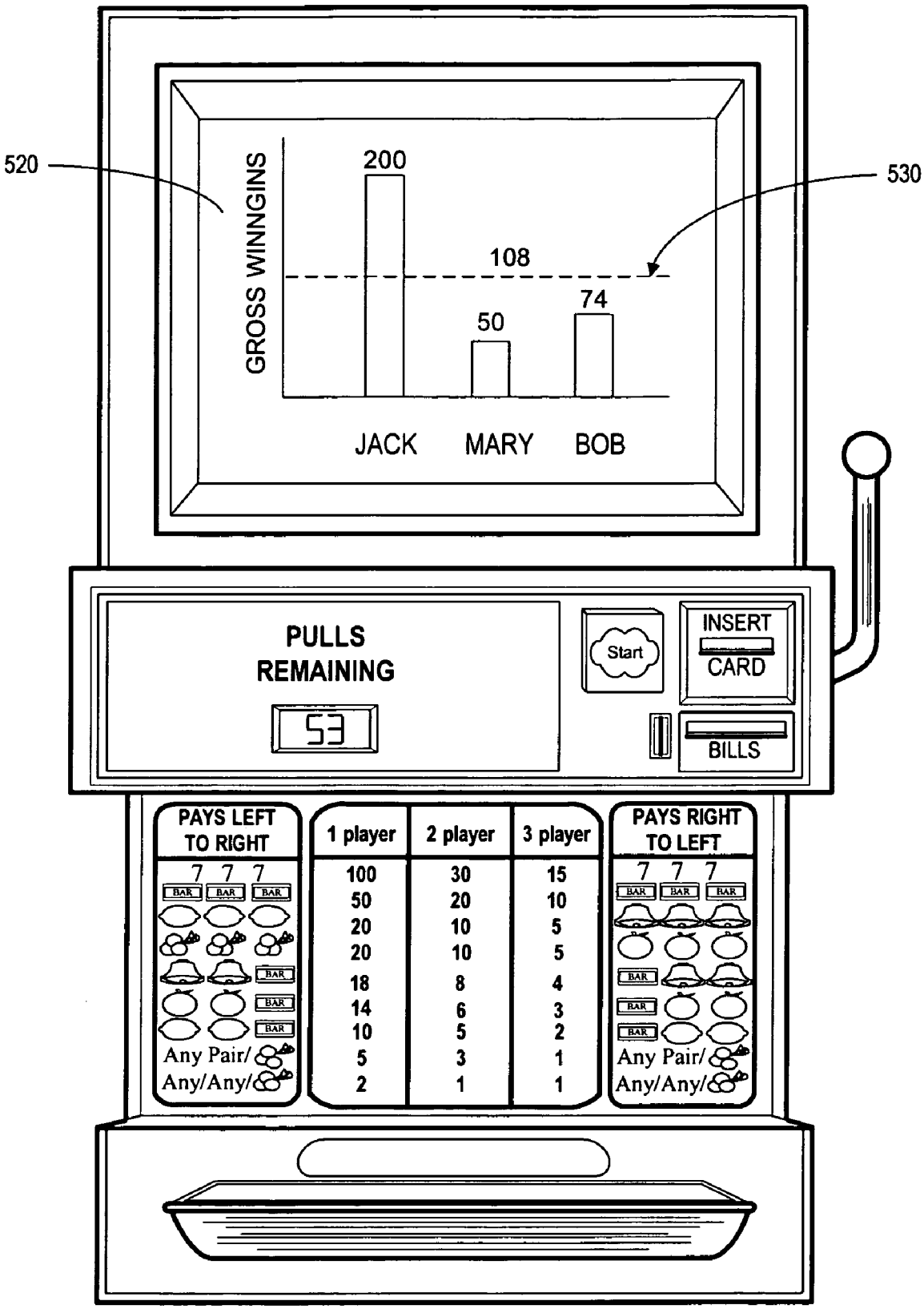
Figure 5C:
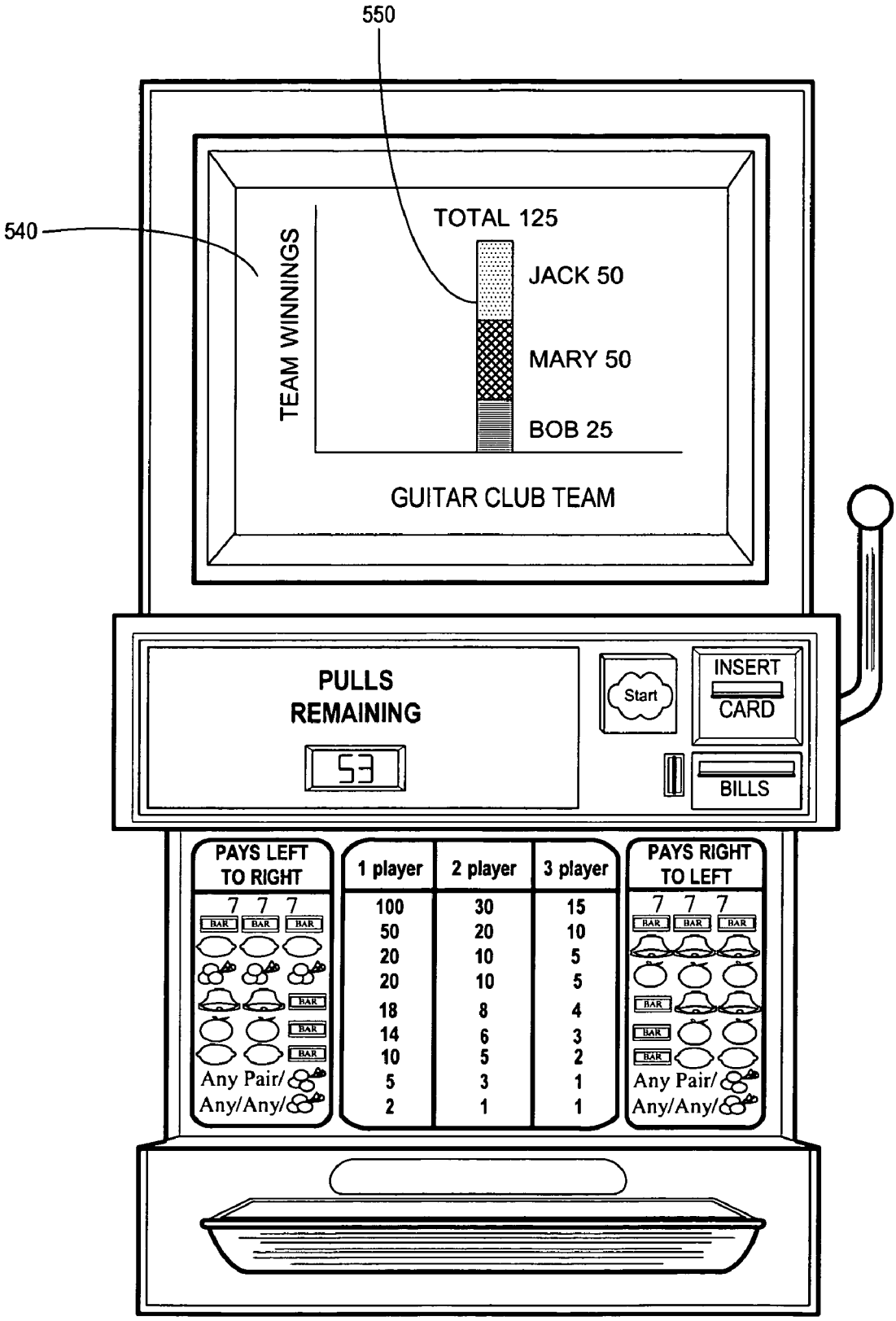
Figure 5D:
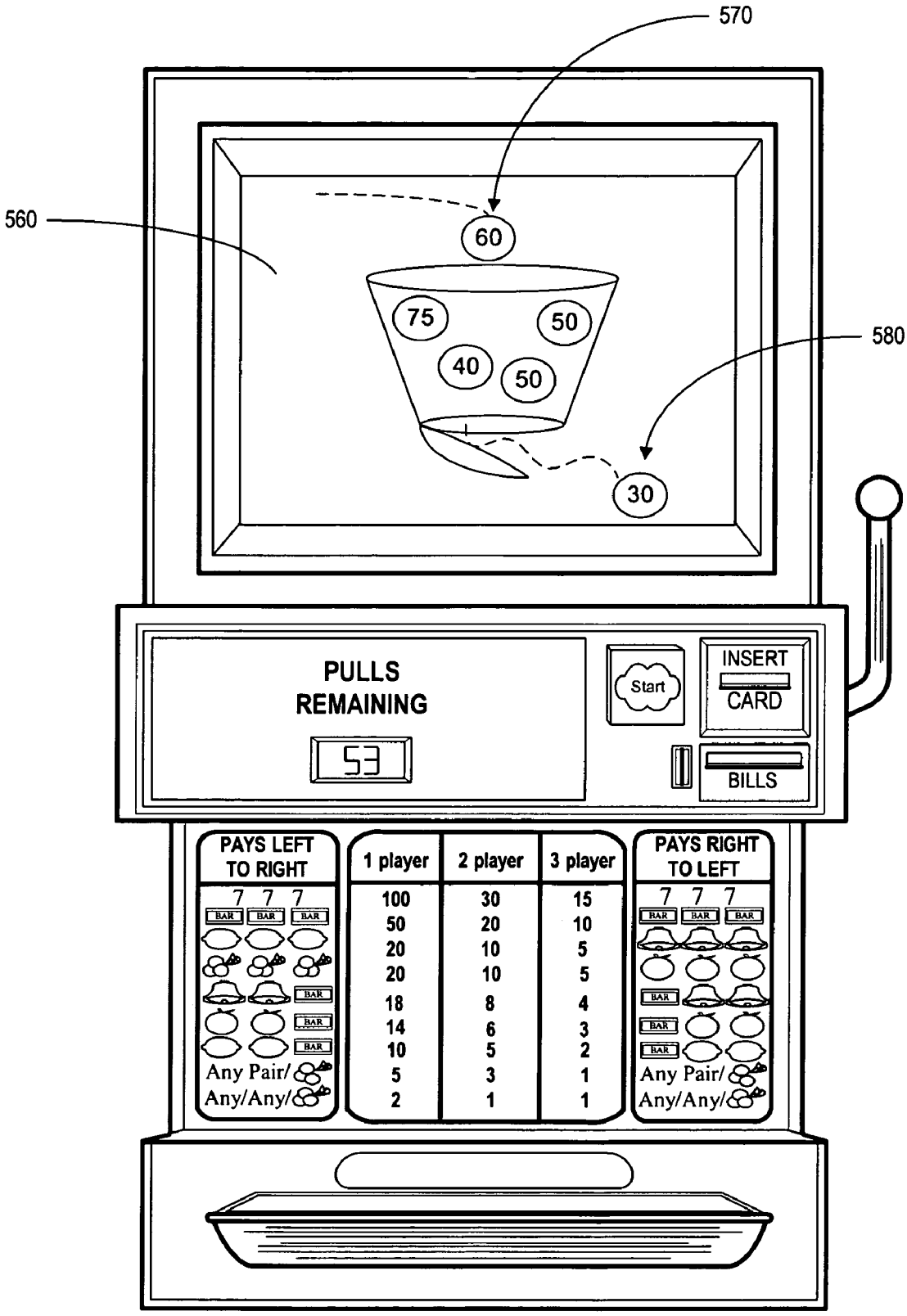

Graphs may also be useful for depicting team results that are averages of the results of individual team players. For instance, the gross winnings for each team member are illustrated using a bar graph. An exemplary bar graph is depicted in FIG. 5B at display 520. Then, a horizontal line 530 is drawn across the graph to show the average gross winnings for all team players. A player who sees the line 530 will notice that the line 530 is below some of the better team player results, while it is above some of the worse team player results. It will thus make sense to the team players that the individual team players' results are being averaged to achieve the team result.

Various embodiments of the present invention derive a team result from the sum of individual players' results. For example, a team result may be the sum of the highest three payouts awarded to any team player during a session. A sum of individual player results may be illustrated in several ways. For instance, a team result may be illustrated using a single bar in a bar graph. An exemplary illustration is provided in FIG. 5C at display 540. The bar 550 is broken up into three colors or shades, with each shade representing the contribution of one of the three highest outcomes. Thus, if a team result consists of outcomes paying, for example, 25, 50, and 50 coins, then the bar 550 may stretch from 0 to 125, and may be colored green from 0 to 25, red from 25 to 75, and yellow from 75 to 125. Of course the bar 550 could be more creatively textured, using for example, outcome indicia, coins, dollar signs, and so on. Each portion of the bar 550 may be tagged to illustrate the size of the payout, or the outcome that contributed to the leg of the bar. For example, the bottom portion of the bar 550 may be tagged "25", the next lowest portion "50", and so on. Each portion of the bar 550 may also be tagged with the name of the person who obtained the corresponding outcome.

In general, any graphic may be used to show how individual outcomes contribute to a larger team outcome, wherein some dimension or other statistic describing the graphic is in a fixed proportion to the amount of the contribution to the team result represented by the graphic. In the example of the bar graph above, the length of each leg of the bar is proportional to the payout of the outcome illustrated by the leg. Of course, the statistic or dimension need not be in a fixed proportion to the amount of the contribution. For example, the length of the leg of a bar graph corresponding to the player contributing the greatest amount may be displayed disproportionately (e.g., disproportionately larger) or otherwise displayed prominently.

In one embodiment, the display of a team member's slot machine 300 must continually update the display of the highest five outcomes obtained by the team thus far. This is because, as the session progresses, players are likely to occasionally achieve outcomes that place in the top five of outcomes generated up to that point in the session. Therefore, the display of the slot machine must remove the now sixth-highest outcome being displayed and display the newly achieved outcome that has placed in the top five.

The continual removal of the sixth-highest outcome, and its replacement with a new outcome, can be graphically illustrated using a bucket metaphor. An exemplary illustration is provided in FIG. 5D at display 560. As a new outcome 570 places in the top five, it is placed in the top of a bucket. The sixth-highest outcome 580 then falls out the bottom of the bucket, and is discarded. In various embodiments of the present invention, those outcomes not placing high enough to replace a previous outcome may be displayed as falling outside of the bucket, and/or all the way through the bucket.

There are, of course, many possible variations to this metaphor. For instance, five outcomes may be displayed as lined up, in numerical order (or in order of outcome value, or in order achieved), at the edge of a cliff. Of course, the outcomes need not be displayed in any particular order. When a new outcome having a value greater than the fifth-highest outcome comes in, for example, it jostles the line, causing the now sixth-highest outcome to fall off the edge of the cliff.

Alternatively, the outcomes may be any predetermined set of outcomes (e.g., the second through seventh highest outcomes; or all outcomes above a threshold value). In such embodiments, when a new outcome having a value greater than the lowest outcome of the group is achieved, for example, the new outcome—causes the lowest outcome to fall out of the bucket, or off the edge of the cliff.

At the end of a session, the outcomes remaining in the bucket, for example, are used to determine the team result. For example, the team result may consist of the four highest outcomes, the six highest outcomes, or numerous other possible combinations of outcomes (e.g., the second, fourth, and fifth highest outcomes).

In some embodiments, a team may achieve a team result that qualifies the team for a bonus game. For example, if the team result exceeds a certain threshold, then the team may enter a bonus round. According to various embodiments, one or more of the team players may have the opportunity to make a decision in a bonus round that affects the outcome of the bonus round. For instance, in a bonus round involving a fantasy forest scene, each team member may suggest a tree beside which to dig for buried treasure. If one of the trees does yield the treasure, then the entire team receives a prize associated with the treasure. Each team player may make his decision from his own slot machine. In one embodiment of the present invention, each team member may view the same virtual scene, and watch as holes are dug beside the trees chosen by each team member.

Based on the identified team session result, each CPU 310 locates the corresponding payout in the appropriate field of the per-session payout database 1200, shown in FIG. 12, based on the number of team players currently playing. When a payout is awarded to the per-session team players, the slot machine 300 stores the credits in a random access memory (RAM) (not shown) or dispenses the appropriate number of coins using the hopper controller 352 and hopper 354.

A player tracking device 360 is also in communication with the CPU 310. The player tracking device 360 comprises a card reader 364 for reading player identification information stored on a player tracking card (not shown), which is preferably encoded with information to identify the player, in a known manner. The player tracking device 360 also preferably includes a display 362, having an associated player interface, such as a numeric keypad 363 for entry of player information. The player card tracking device may be embodied, for example, as the Mastercom device, commercially available from Bally Manufacturing. For a discussion of player card tracking devices, see, for example, U.S. Pat. No. 5,429,361 to Raven et al., incorporated by reference herein.

The slot machine 300 also includes a slot network interface 376 that provides a communication path between the representative slot machine 300 and the slot server 200. Thus, as discussed further below, information may be communicated among the player tracking device 360, slot machine 300 and slot server 200.

Databases

As previously indicated, the player database 600, shown in FIG. 6, stores information on each player, including an identifier of each player's team (or teams), if any, and the player's loyalty reward points balance. The player database 600 maintains a plurality of records, such as records 605 through 620, each associated with a different player. For each player identified by a player identifier in field 630, the player database 600 includes the name and address of the player in fields 635 and 640, respectively. In addition, the player database 600 includes an identifier of each team the player is associated with in field 645. Finally, the player database 600 includes each player's current loyalty reward points balance in field 650. As previously indicated, the registered team database 700, shown in FIG. 7, stores information on each team that is registered for slot machine play, including an identification of each team member. The registered team database 700 maintains a plurality of records, such as records 705 and 710, each associated with a different team. For each team identified by a team identifier in field 720, the registered team database 700 includes an indication of each team player in fields 725 through 735, and the duration of each session for the illustrative per-session embodiment in field 740. In this manner, the slot server 200 can determine the names and player identifiers of each player on a given team.

A team database might further include team preferences. By storing team preferences, a slot server 200 could make it easier for a team to begin a playing session similar in nature to a prior team session. Team preferences might include the preferred type of slot machine to be used by a team, the preferred game to be played on a slot machine, the preferred length of a session, the preferred method of combining individual results into team results, the preferred method by which individual game results are to be displayed to other team members, and so on.

Figure 8:
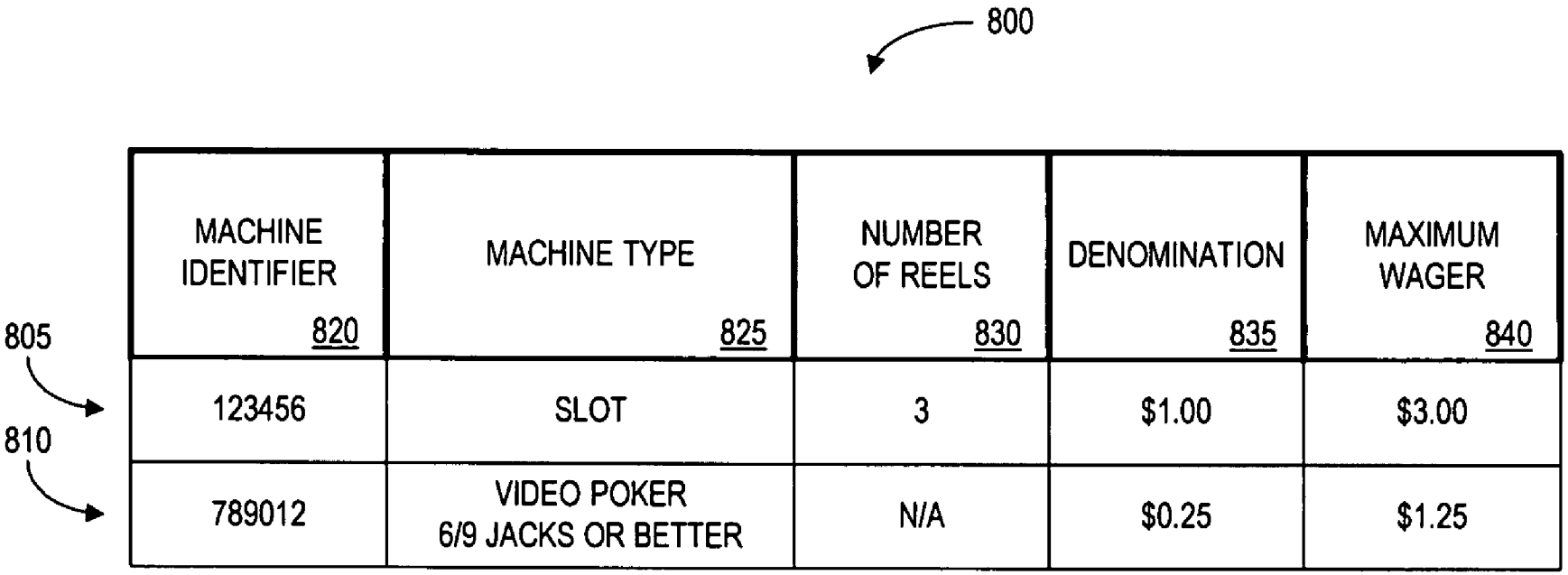
FIG. 8 illustrates a sample table from the machine database of FIG. 2.

As previously indicated, the machine database 800, shown in FIG. 8, stores information on each slot machine in a casino, including the type of each machine. The machine database 800 maintains a plurality of records, such as records 805 and 810, each associated with a different slot machine, such as the slot machine 300. For each slot machine identified by a machine identifier in field 820, the illustrative machine database 800 indicates the machine type in field 825, and the associated number of reels, possible denominations and maximum wager in field 830 through 840, respectively. In this manner, the slot server 200 can determine if each team player is utilizing a compatible slot machine 300-303.

As previously indicated, the per-spin transaction database 900, shown in FIG. 9, stores play results for each team playing in a per-spin embodiment of the present invention. The per-spin transaction database 900 maintains a plurality of records, such as records 905 and 910, each associated with a different team. For each team identified by a team identifier in field 920, the per-spin transaction database 900 includes the per-spin results for each team player in fields 930, 940 and 950. Specifically, for a first team player, the per-spin results include an identifier of the player in field 931, the corresponding game result in fields 932 through 934, and an identifier of the machine utilized by the player in field 935. In this manner, the slot server 200 can analyze the per-spin individual game results of each player on a given team and combine them in a predefined manner to obtain a team game result. In one embodiment, the individual game results are combined by selecting the symbol in each reel position that provides the team with the best overall game result having the highest payout.

As previously indicated, the per-session transaction database 1000, shown in FIG. 10, stores play results for each team playing in a per-session embodiment of the present invention. The per-session transaction database 1000 maintains a plurality of records, such as records 1005 and 1010, each associated with a different team. For each team identified by a team identifier in field 1020, the per-session transaction database 1000 includes the to-date session results for each team player in fields 1030, 1040 and 1050. Specifically, for a first player, the to-date session results include an identifier of the player in field 1031, an identifier of the machine utilized by the player in field 1032, and the current coin-in, coin-out and net values (coin-out less coin-in) in fields 1033 through 1035, respectively. In this manner, upon completion of a defined session, the slot server 200 can combine the individual net results of each team player to obtain the team session result. In one embodiment, the individual net results are combined by selecting the highest net result of each player on a given team and adjusting the coin-out of the additional players to obtain the same net result. As previously indicated, the per-spin payout database 1100, shown in FIG. 11, stores the payouts associated with each winning reel combination for a number of team sizes, for the per-spin embodiment. The per-spin payout database 1100 maintains a plurality of records, such as records 1102-1134, each associated with a different possible game result. For each possible game result identified in field 1140, the per-spin payout database 1100 includes the corresponding prize awarded for a single player, two member team and three member team in fields 1150 through 1170, respectively.

For example, if a single player not associated with a team hits the reel combination "orange/orange/orange," shown in record 1118, the player will be awarded 20 credits for the illustrative one-coin wager model. Likewise, if the team game result for a two member team is the reel combination "orange/orange/orange," each member of the team will be awarded 10 credits for the illustrative one-coin wager model. In a multiple coin play embodiment of the slot machine 300, the per-spin payout database 1100 can include additional fields for recording payouts associated with the number of coins wagered by the player, as well as the corresponding team size, as would be apparent to a person of ordinary skill in the art. Generally, the payout for a given game result decreases as the size of a team increases, to compensate for the increased probability of a winning game result.

As previously indicated, the per-session payout database 1200, shown in FIG. 12, stores the payouts associated with each winning reel combination for a number of team sizes, for the per-session embodiment. The per-session payout database 1200 maintains a plurality of records, such as records 1202-1234, each associated with a different possible game result. For each possible game result identified in field 1240, the per-session payout database 1200 includes the corresponding prize awarded for a single player, two member team and three member team in fields 1250 through 1270, respectively.

For example, if a single player hits the reel combination "orange/orange/orange," shown in record 1218, the player will be awarded 20 credits for the illustrative one-coin wager model. Likewise, if a player from a two member team hits the reel combination "orange/orange/orange," on an individual pull of a team session, the individual player will be awarded 15 credits for the illustrative one-coin wager model. In a multiple coin play embodiment of the slot machine 300, the per-spin payout database 1200 can include additional fields for recording payouts associated with the number of coins wagered by the player, as well as the corresponding team size, as would be apparent to a person of ordinary skill in the art. Because player net results approach the expected value return as the number of plays in the session increases, per-session payout database 1200 may be modified to generally increase payout levels for longer sessions.

As previously indicated, the per-spin probability database 1300, shown in FIG. 13, stores the probability that a given reel combination will result for a number of team sizes in the per-spin embodiment, for an illustrative slot machine having three reels, each with two hundred twenty (220) virtual reel stop positions. The number of reel stops on each reel of the illustrative per-spin embodiment of the present invention has been increased by a factor of ten over a conventional twenty-two stop machine, in order to permit the probability of the occurrence of the "seven" symbol (7) to be reduced for team sizes greater than one. It is noted that a game result is selected in the illustrative per-spin embodiment by generating three random numbers and looking up the result in the per-spin probability database 1300.

The per-spin probability database 1300 maintains a plurality of records, such as records 1305-1330, each associated with a different reel symbol. For each reel symbol identified in field 1140, the per-spin probability database 1300 indicates the number of times, on average, that the reel symbol will result on each reel for each 220 token plays of the slot machine 300 in fields 1351-1353, 1361-1363 and 1371-1373 for a single player, two member team and three member team, respectively. In an alternate embodiment, the probability of a winning game result can be reduced by dynamically increasing the number of reels 332, 334, 336.

As previously indicated, the per-session probability database 1400, shown in FIG. 14, stores the probability that a given reel combination will result for a number of team sizes in the per-session embodiment, for an illustrative slot machine having three reels, each with twenty two (22) symbols. Thus, as shown in field 1252 of record 1202, 8,570 combinations out of a possible 10,648 reel combinations result in a nonwinning game result for a single player in a per-session embodiment.

The per-session probability database 1400 maintains a plurality of records, such as records 1402-1436, each associated with a different possible game result. For each possible game result identified in field 1440, the per-session probability database 1400 includes the random numbers which lead to that reel combination for a single player in field 1452, and the corresponding number of times, on average, that the game result will occur for each 10,648 token plays of the slot machine 300 in field 1454. Likewise, the per-session probability database 1400 indicates the random numbers and corresponding expected hits per cycle for the two member team and three member team in fields 1462-1464 and 1472-1474, respectively.

For example, the game result "orange/orange/orange," shown in record 1420 of the per-session probability database 1400, will be theoretically expected 42 times for each 10,648 token plays of the illustrative slot machine 300 by a single player of the per-session embodiment. In an illustrative embodiment, the symbol "orange" appears twice on reel number one, three times on reel number two, and seven times on reel number three. Thus, the probability that the game result "orange/orange/orange" will result is 42 (2×3×7) out of the total 10,648 possible game results (22×22×22) for a single player of the per-session embodiment. Likewise, the probability that the game result "orange/orange/orange" will result is 30 out of the total 10,648 possible game results for a player from a two member team on an individual pull of a team session.

The expected hits per cycle for the multiple player teams set forth in fields 1460 and 1470 are similar to those set forth in field 1450 for an individual player, except for the decreased probability of a number of winning game results (in order to find team play). There are a number of ways to accomplish a decrease in the probability of a winning combination. In the illustrative example shown in FIG. 14, the probability of a winning combination for the multiple player teams has been decreased by increasing the number of nonwinning combinations for the multiple player teams, and providing a corresponding decrease to the winning combinations. For example, when random numbers in the range 8571 through 8917 are generated, they will result in nonwinning combinations for the two member team, as opposed to winning combinations for the individual player. In an alternative embodiment, a decrease in the probability of a winning combination for team play can be achieved by reallocating the symbol-to-reel allocation utilized by the slot machine 300 by increasing the number of symbols which do not contribute to winning combinations.

It is again noted that the representative data provided in the per-spin and per-session payout databases 1100, 1200 and the per-spin and per-session probability databases 1300, 1400 are meant to be examples of values that could be utilized to keep the house advantage approximately the same for team play as for individual play with conventional slot machines, as would be apparent to a person of ordinary skill in the art.

Processes

As previously indicated, the slot server 200 and the individual slot machines 300-303 being utilized by team players execute a number of cooperative processes in order to coordinate team play in both the per-spin and per-session embodiments. As discussed below in conjunction with FIGS. 15 and 16, the individual slot machines 300-303 and the slot server 200 each execute per-spin processes 1500, 1600, respectively, to implement the per-spin embodiment of the present invention. Likewise, as discussed below in conjunction with FIGS. 17 and 18, the individual slot machines 300-303 and the slot server 200 each execute per-session processes 1700, 1800, respectively, to implement the per-session embodiment of the present invention.

Figure 15A:
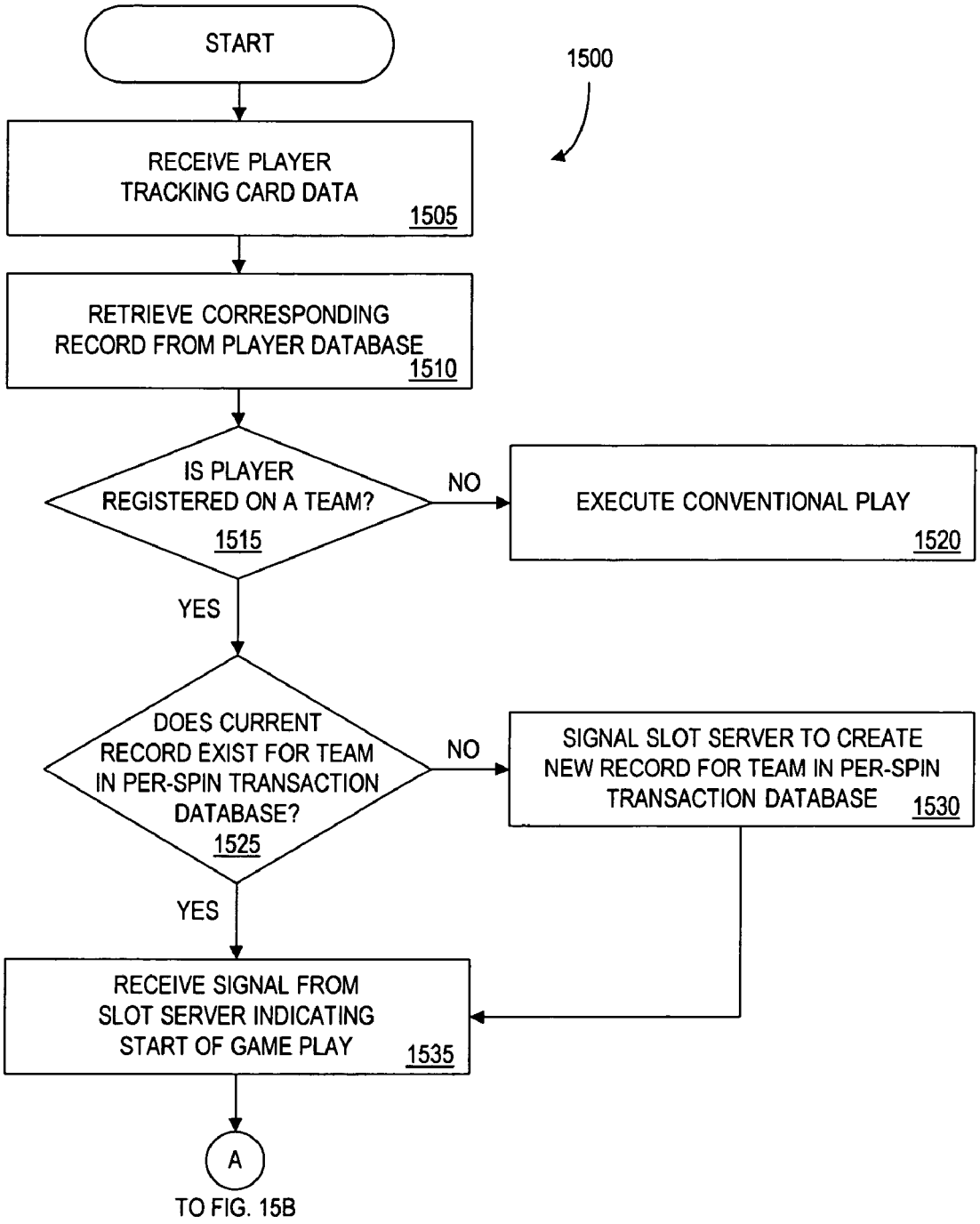
FIGS. 15A through 15C, collectively, are a flowchart describing an exemplary per-spin process implemented by the slot machine of FIG. 3.
Figure 15B:
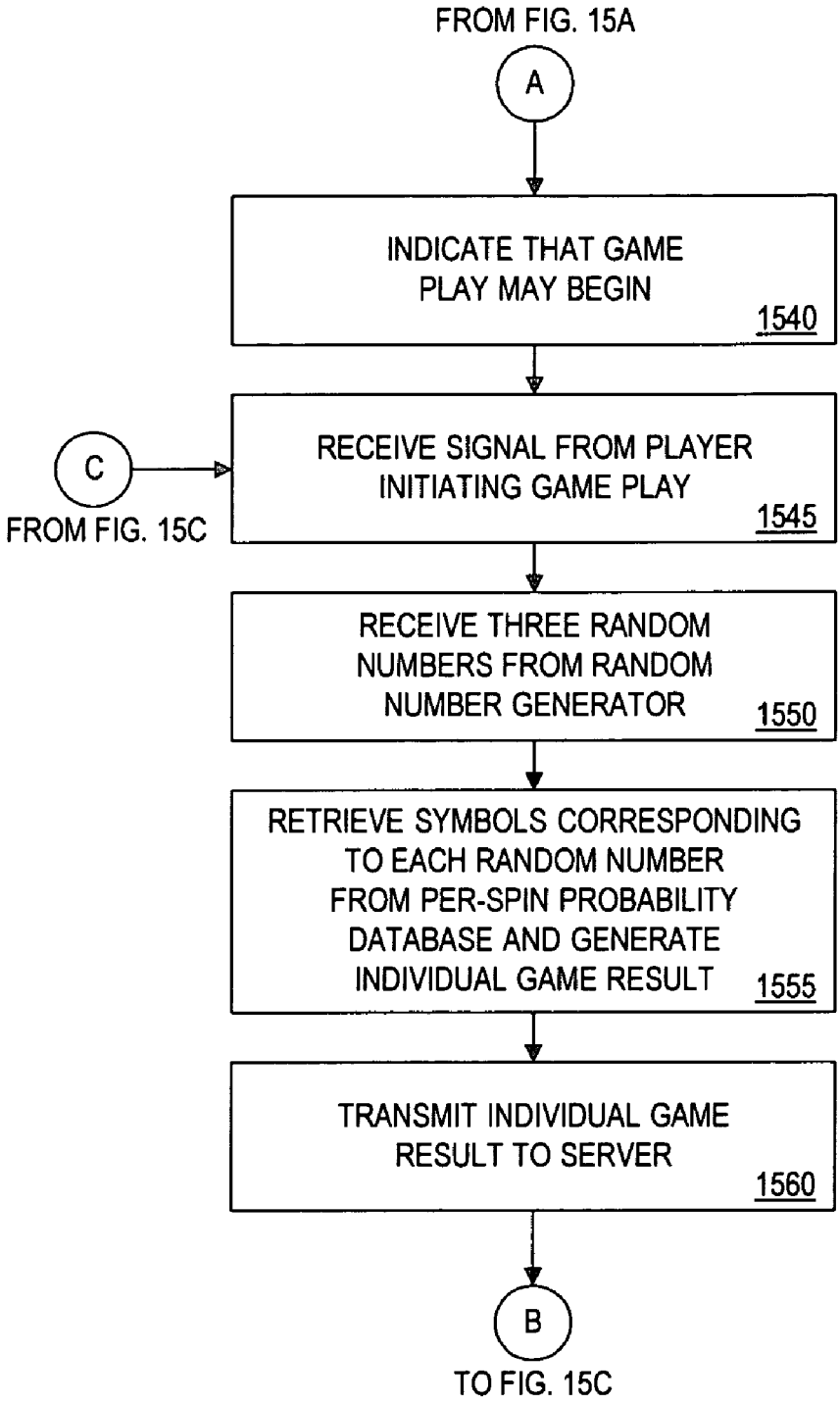
Figure 15C:
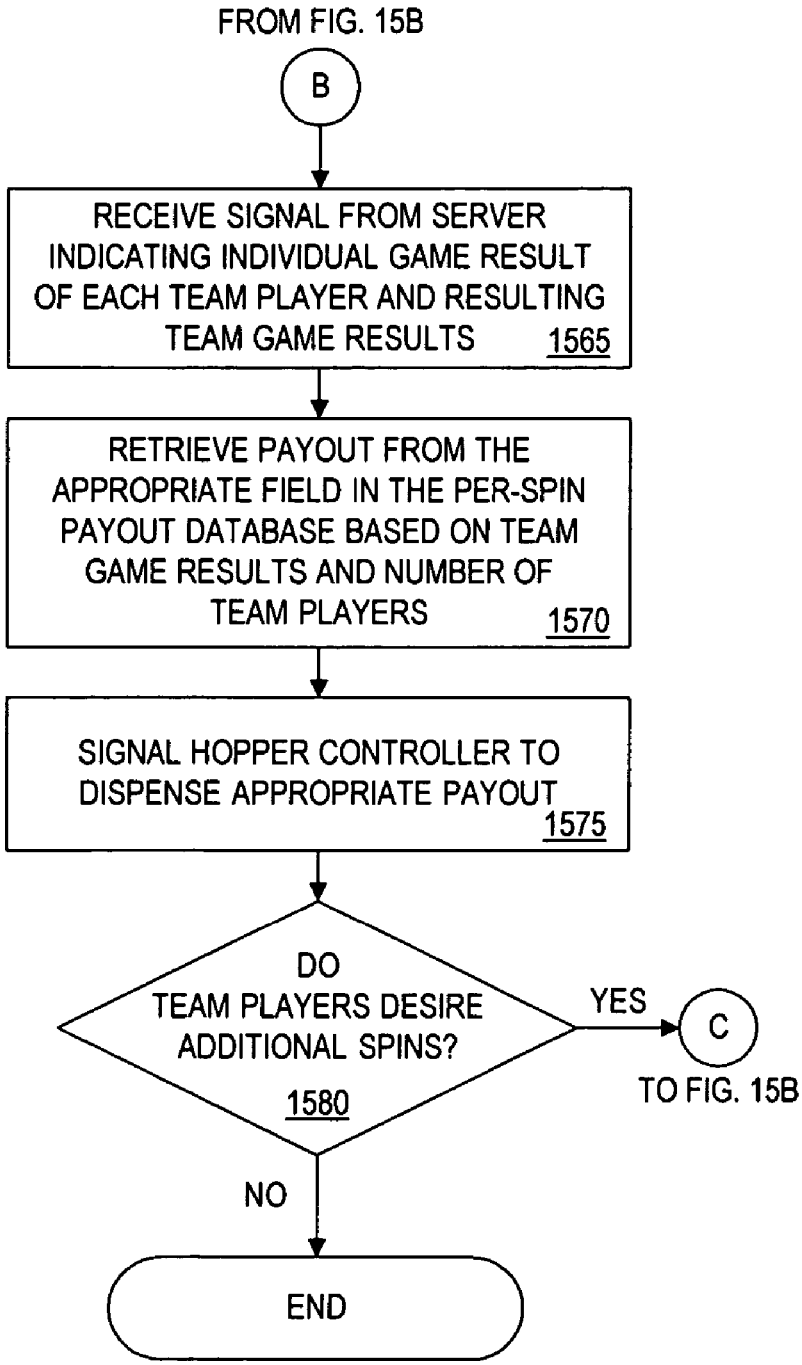

As shown in FIG. 15A, in the per-spin embodiment, an individual representative slot machine 300 initiates the per-spin process 1500 upon receipt of player tracking data from the player tracking device 360 during step 1505. The slot machine 300 then retrieves the corresponding record from the player database 600, which may be stored locally or at the slot server 200, during step 1510.

A test is performed during step 1515 to determine if the player is registered on a team. If it is determined during step 1515 that the player is not registered on a team, then conventional slot machine play will continue during step 1520. If, however, it is determined during step 1515 that the player is registered on a team, then a further test is performed during step 1525 to determine if a record exists for the team in the per-spin transaction database 900. If it is determined during step 1525 that a record does not exist for the team in the per-spin transaction database 900, then the slot machine 300 signals the slot server 200 to create a new record for the team in the per-spin transaction database 900 during step 1530, before program control proceeds to step 1535.

The slot machine 300 receives a signal from the slot server 200 during step 1535 indicating the start of team play. The slot machine 300 then indicates to the player during step 1540 (FIG. 15B) that game play may begin and receives a signal from the player initiating game play during step 1545. Three random numbers are obtained from the random number generator 378 during step 1550. The symbols corresponding to each random number are then retrieved from the per-spin probability database 1300 during step 1555 and the individual game result is generated for the team player. The individual game result is then transmitted to the slot server 200 during step 1560.

Thereafter, each individual slot machine 300-303 where team players are playing receives a signal from the slot server 200 during step 1565 (FIG. 15C) indicating the individual game result of each team player and the resulting team game result. The appropriate payout is retrieved from the per-spin payout database 1100 during step 1570, based on the team game result and the number of team players. The hopper controller 352 is instructed to dispense the appropriate payout to the team player during step 1575. A test is performed during step 1580 to determine if the team players desire additional spins. If it is determined during step 1580 that the team players do desire additional spins, then program control returns to step 1545 (FIG. 15B) for further play in the manner described above. If, however, it is determined during step 1580 that the team players do not desire further spins, then program control will terminate.

Figure 16A:
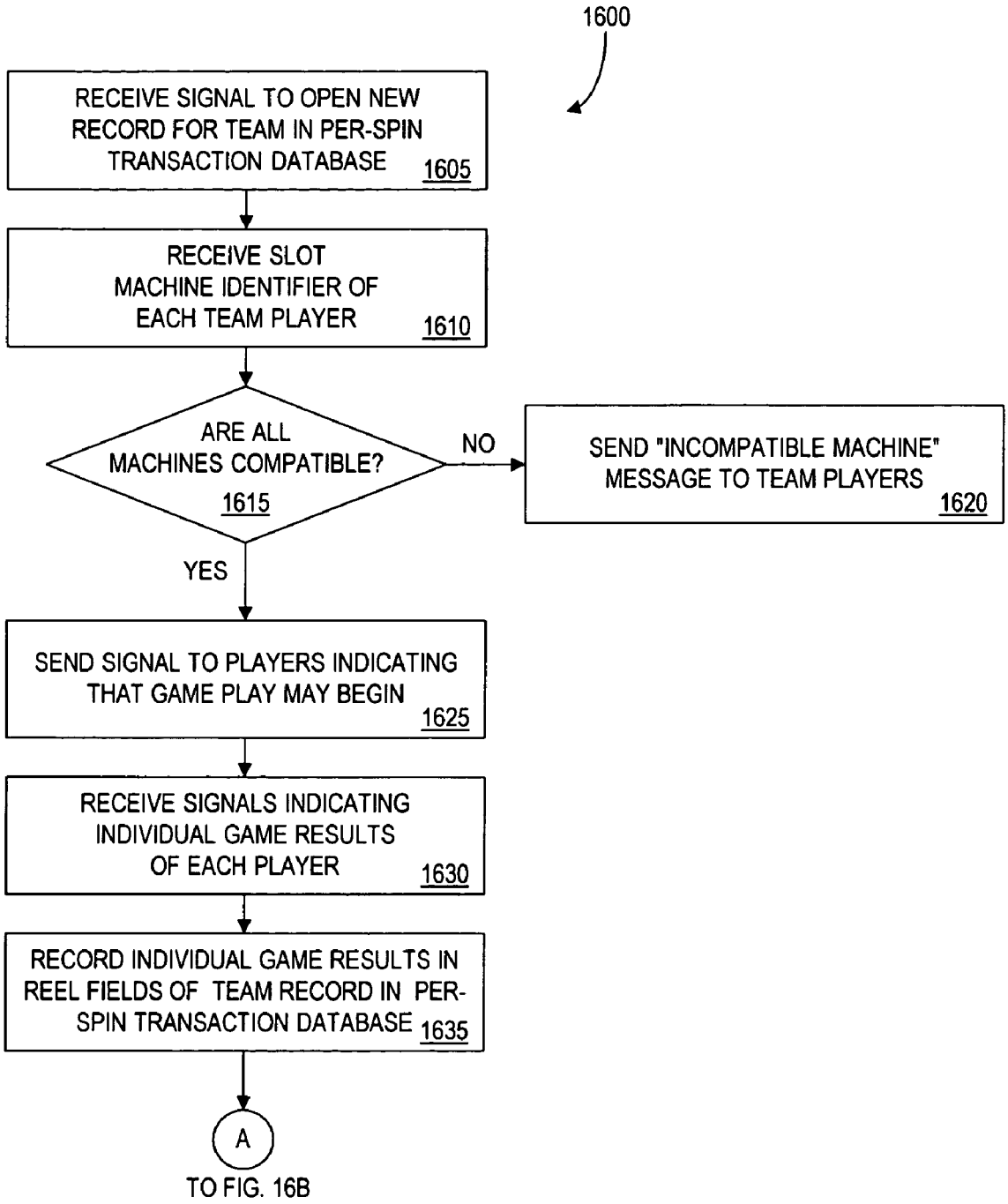
FIGS. 16A and 16B, collectively, are a flowchart describing an exemplary per-spin process implemented by the slot server of FIG. 2.
Figure 16B:
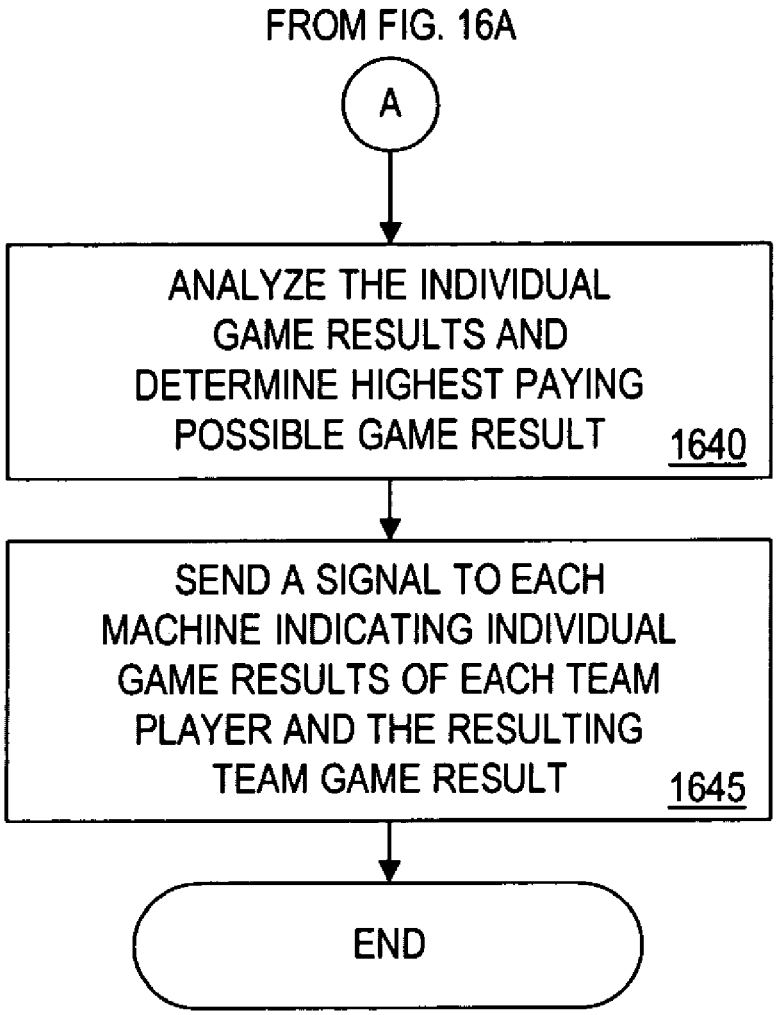

As previously indicated, the slot server 200 executes a per-spin process 1600, shown in FIG. 16, in cooperation with the per-spin processes 1500 being executed by the individual slot machines 300-303 being utilized by team players. As shown in FIG. 16A, the slot server 200 initiates the per-spin process 1600 upon receipt of a signal from one or more of the individual slot machines 300-303 being utilized by team players during step 1605 to open a new record for a team in the per-spin transaction database 900. Thereafter, the slot server 200 will receive an identifier of each of the individual slot machines 300-303 being utilized by team players during step 1610.

A test is performed during step 1615 to determine if each of the individual slot machines 300-303 being utilized by team players are compatible. If it is determined during step 1615 that each of the individual slot machines 300-303 being utilized by team players are not compatible, then a message is sent to each of the individual slot machines 300-303 being utilized by team players during step 1620 indicating that one or more of the machines are not compatible. If, however, it is determined during step 1615 that each of the individual slot machines 300-303 being utilized by team players are compatible, then a signal is sent to the team players during step 1625 indicating that game play may begin.

After each spin, the slot server 200 receives signals from each of the individual slot machines 300-303 being utilized by team players during step 1630 indicating the individual game results of each team player. The individual game results are then recorded in the appropriate team record in the per-spin transaction database 900 during step 1635. The slot server 200 analyzes the individual game results during step 1640 (FIG. 16B) and then determines the team game result providing the highest possible payout. The slot server 200 then sends a signal to each of the individual slot machines 300-303 being utilized by team players during step 1645 indicating the individual game results of each team player, and the resulting team game result, before program control terminates.

Figure 17A:
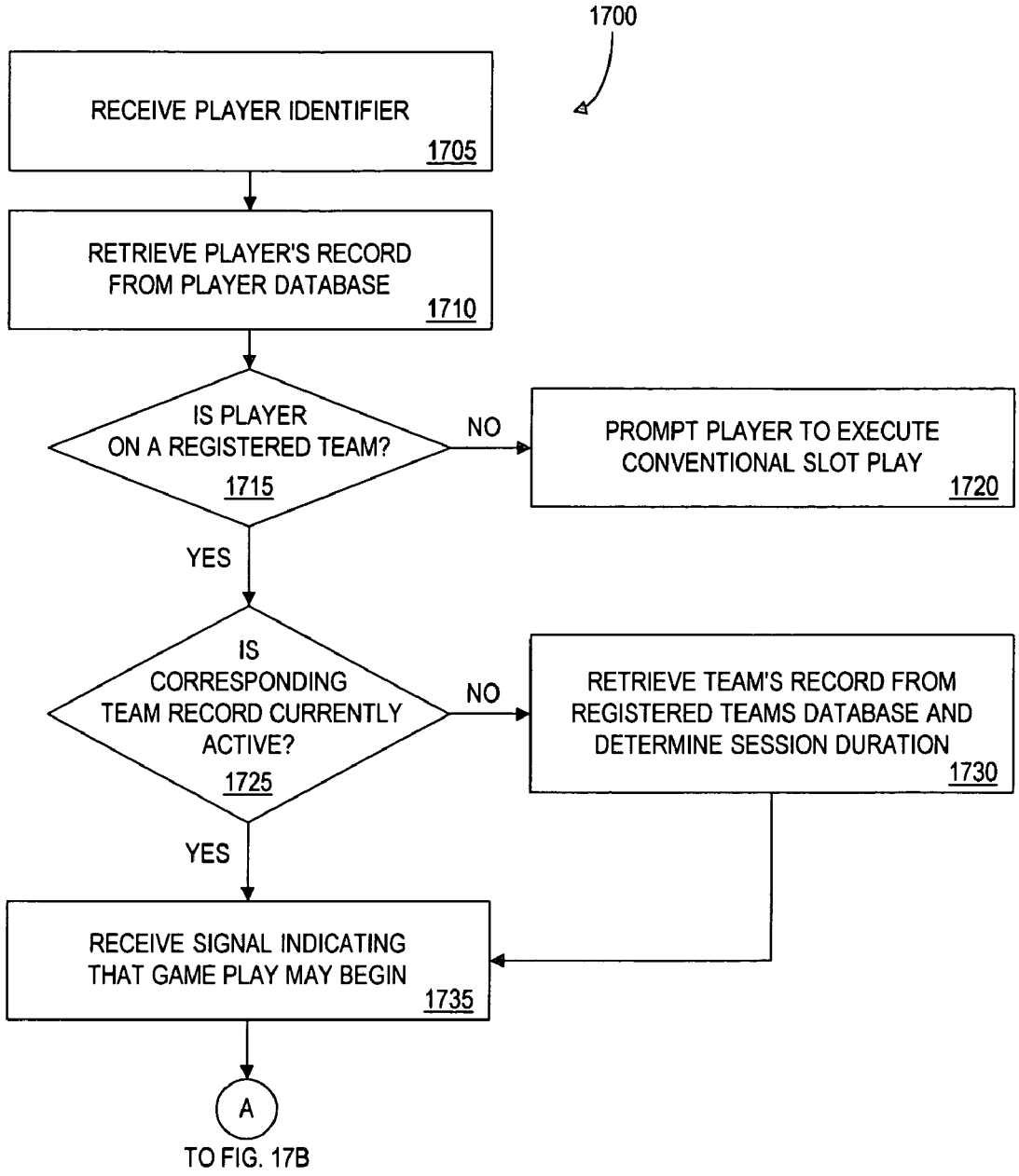
FIGS. 17A through 17C, collectively, are a flow chart describing an exemplary per-session process implemented by the slot machine of FIG. 3.
Figure 17B:
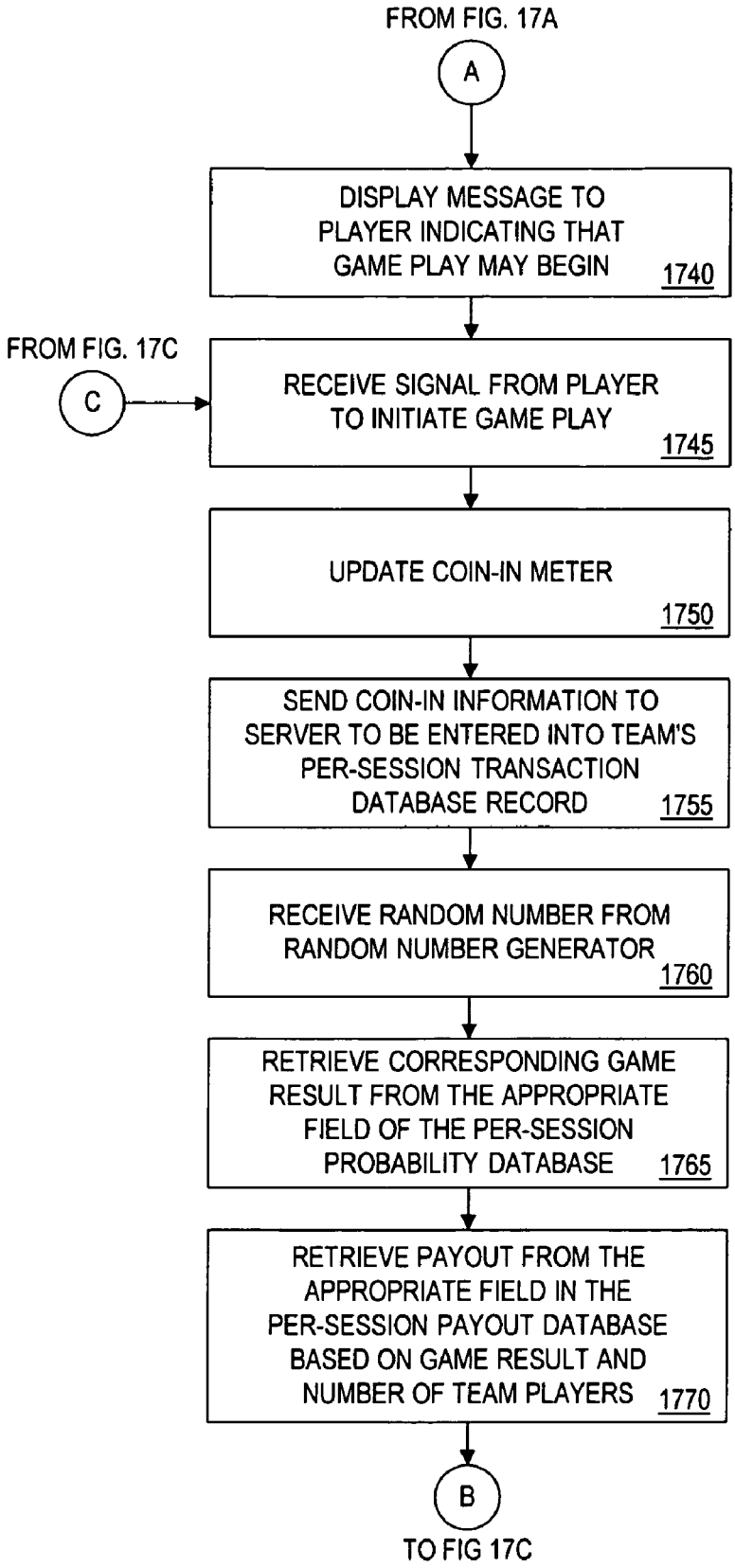
Figure 17C:
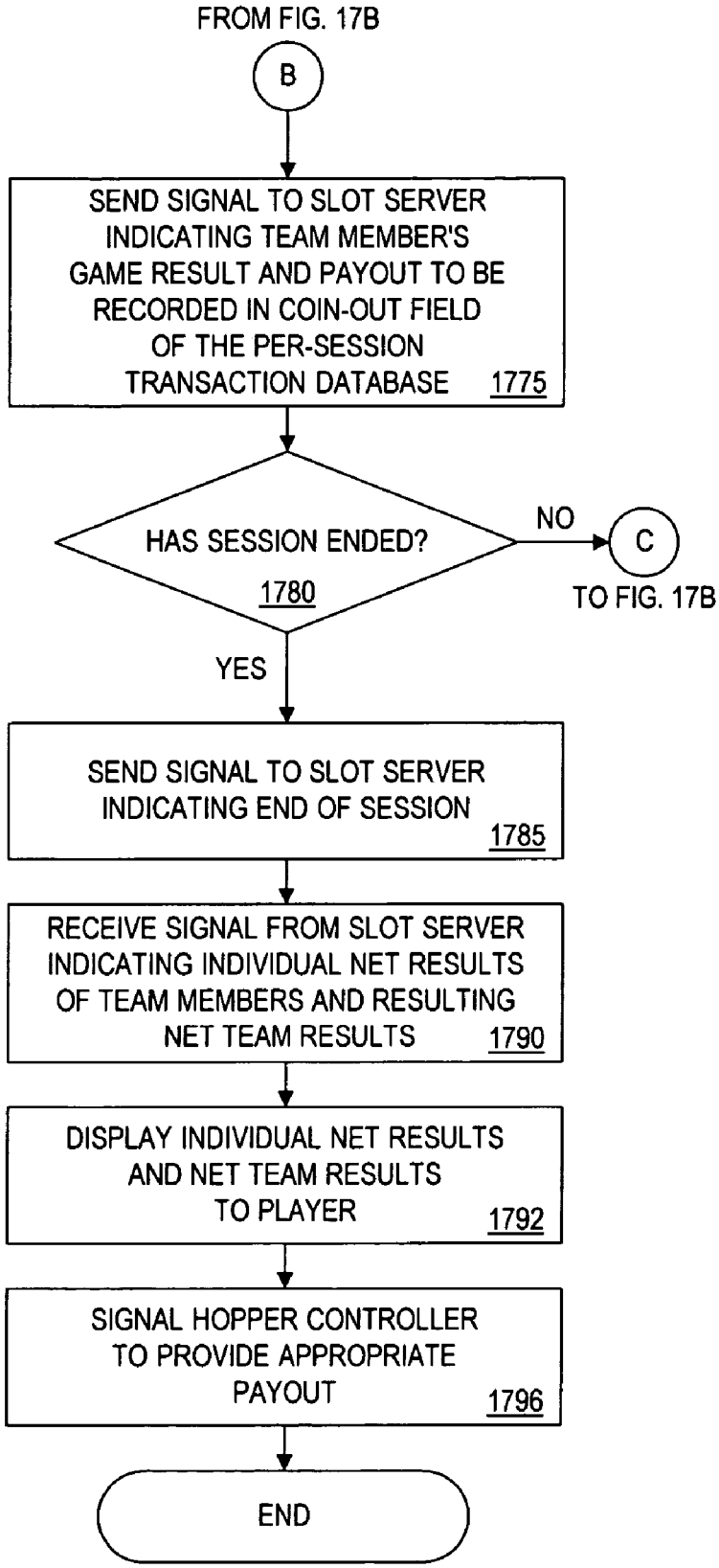
Figure 18A:
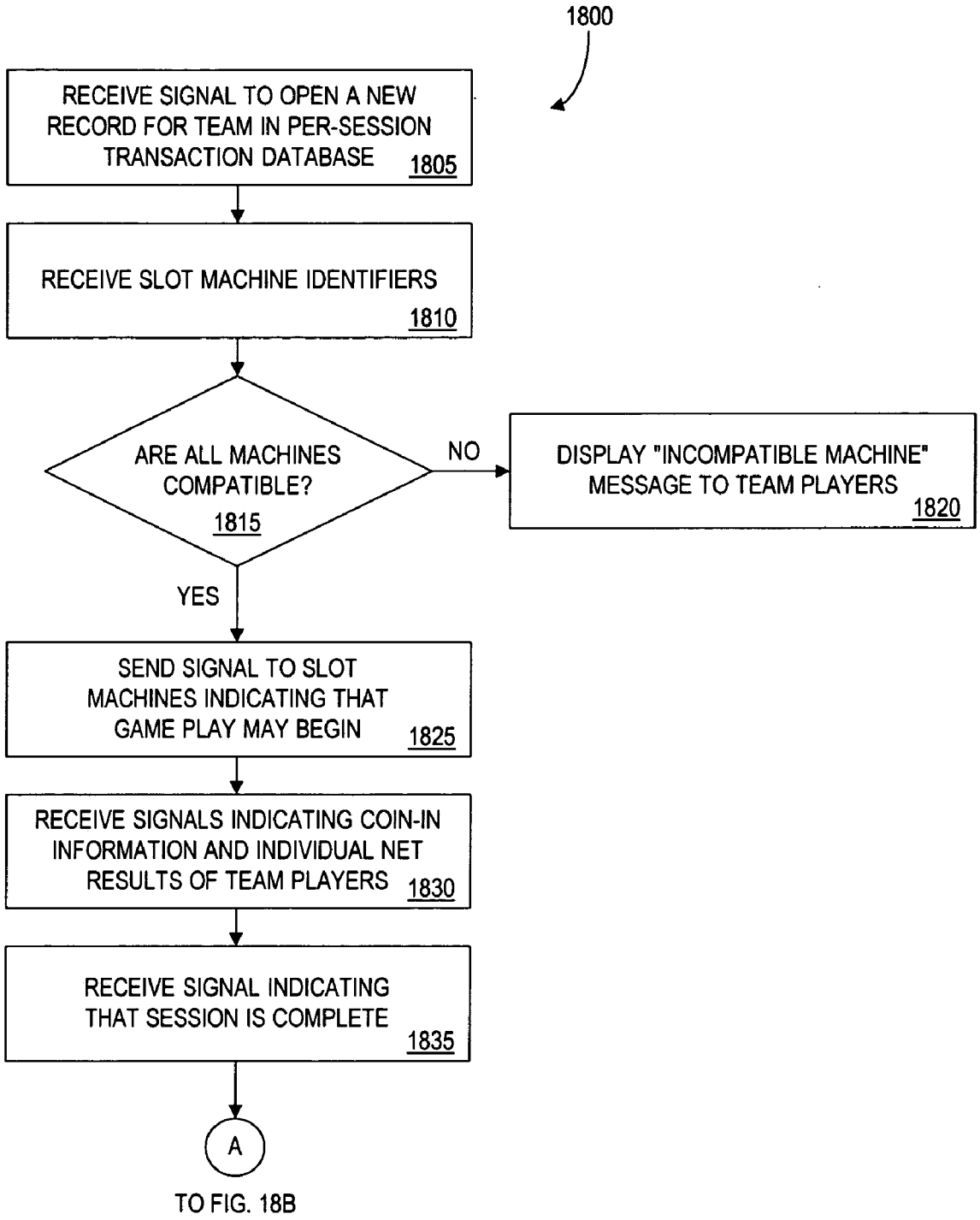
FIG. 18A through 18B, collectively, are a flow chart describing an exemplary per-session process implemented by the slot server of FIG. 2.
Figure 18B:
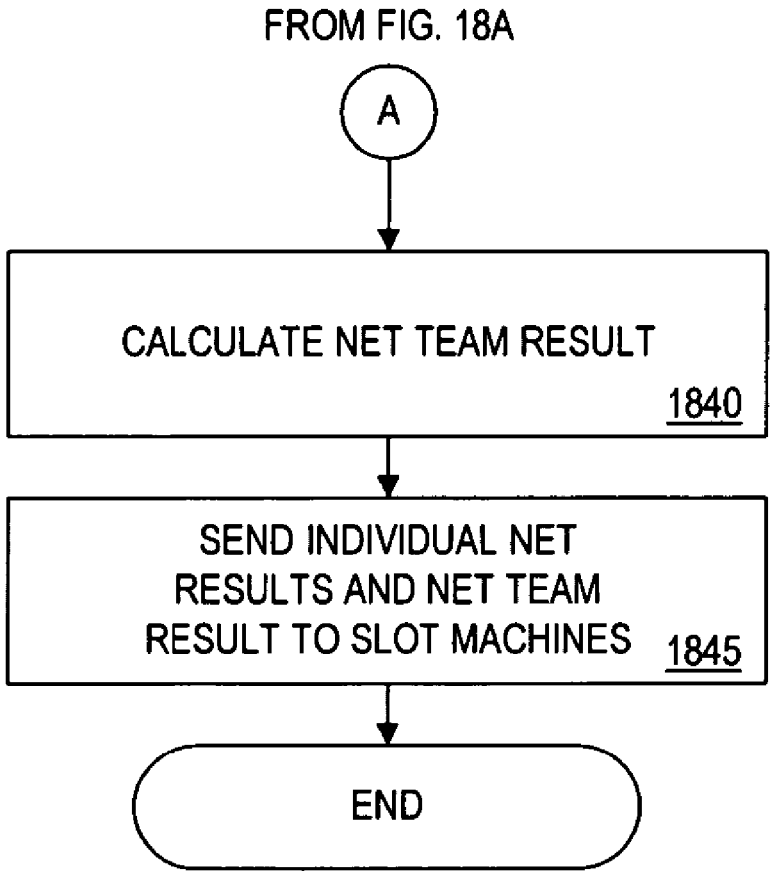

As previously indicated, the individual slot machines 300-303 and the slot server 200 each execute per-session processes 1700, 1800, shown in FIGS. 17 and 18, respectively, to implement the per-session embodiment of the present invention. As shown in FIG. 17A, in the per-session embodiment, an individual representative slot machine 300 initiates the per-session process 1700 upon receipt of player tracking data from the player tracking device 360 during step 1705. The slot machine 300 then retrieves the corresponding record from the player database 600, which may be stored locally or at the slot server 200, during step 1710.

A test is performed during step 1715 to determine if the player is registered on a team. If it is determined during step 1715 that the player is not registered on a team, then conventional slot machine play will continue during step 1720. If, however, it is determined during step 1715 that the player is registered on a team, then a further test is performed during step 1725 to determine if a record exists for the team in the per-session transaction database 1000. If it is determined during step 1725 that a record does not exist for the team in the per-session transaction database 1000, then the slot machine 300 signals the slot server 200 to create a new record for the team in the per-session transaction database 1000 during step 1730, before program control proceeds to step 1735.

The slot machine 300 receives a signal from the slot server 200 during step 1735 indicating the start of team play. The slot machine 300 then indicates to the player during step 1740 (FIG. 17B) that game play may begin and receives a signal from the player initiating game play during step 1745. The coin-in meter is updated during step 1750 to indicate the number of coins (or other form of payment) deposited by the player to initiate play. In addition, the coin-in information is sent to the slot server 200 during step 1755 for entry in the appropriate team record of the per-session transaction database 1000.

A random number is received from the random number generator 378 during step 1760, which is utilized during step 1765 to retrieve the corresponding game result from the appropriate field of the per-session probability database 1400. The payout corresponding to the retrieved game result is then retrieved during step 1770 from the per-session payout database 1200, based on the game result and the number of team players.

A signal is sent to the slot server 200 during step 1775 (FIG. 17C) indicating the team member's game result and payout for recording in the coin-out field of the per-session transaction database 1000. A test is performed during step 1780 to determine if the session has ended. If it is determined during step 1780 that the session has not ended, program control returns to step 1745 (FIG. 17B) for further play in the manner described above. If, however, it is determined during step 1780 that the session has ended, then a signal is sent to the slot server 200 during step 1785 indicating the end of the session.

Thereafter, a signal is received from the slot server 200 during step 1790 indicating the individual net results of each team player, and the resulting team session result. The individual net results and team session results are displayed to each team player during step 1792 using display 510 (FIG. 5A), and the appropriate payout is awarded to each team player during step 1796, before program control terminates.

As previously indicated, the slot server 200 executes a per-session process 1800, shown in FIG. 18, in cooperation with the per-session processes 1700 being executed by the individual slot machines 300-303 being utilized by team players. As shown in FIG. 18, the slot server 200 initiates the per-session process 1800 upon receipt of a signal from one or more of the individual slot machines 300-303 being utilized by team players during step 1805 to open a new record for a team in the per-session transaction database 1000. Thereafter, the slot server 200 will receive an identifier of each of the individual slot machines 300-303 being utilized by team players during step 1810.

A test is performed during step 1815 to determine if each of the individual slot machines 300-303 being utilized by team players are compatible. If it is determined during step 1815 that each of the individual slot machines 300-303 being utilized by team players are not compatible, then a message is sent to each of the individual slot machines 300-303 being utilized by team players during step 1820 indicating that one or more of the machines are not compatible. If, however, it is determined during step 1815 that each of the individual slot machines 300-303 being utilized by team players are compatible, then a signal is sent to the team players during step 1825 indicating that game play may begin.

As per-session play continues, the slot server 200 will receive signals from each of the individual slot machines 300-303 being utilized by team players during step 1830, indicating the coin-in information and the individual net results of team players. Thereafter, once the session has ended, the slot server 200 will receive a signal from one or more of the individual slot machines 300-303 being utilized by team players during step 1835, indicating that the session is complete.

The slot server 200 calculates the team session result during step 1840. The slot server 200 then transmits the individual net results of each team player and the team session result to each of the individual slot machines 300-303 being utilized by team players during step 1845, before program control terminates.

As previously indicated, the present invention may be applied to video poker machines, as well as to the illustrative slot machines 300-303. In a video poker implementation, the game results of each player on a given team are combined, and the result providing the highest payout, is provided to each of the team members. The game results of each player on a given team may be combined, for example, by compiling the cards from every team player and selecting the hand with the highest possible payout from all of the drawn cards. In a further variation, each of the players on a team are dealt the same hand, and draw additional cards in a conventional manner. The best hand drawn by one of the team players is then selected as the team result. If more than one player on the team gets the same highest payout result, a bonus can be awarded to the team. In this manner, a team strategy where every player always picks a different draw combination than the other players is discouraged.

In yet another variation, each of the players on a team is dealt the same hand, and then votes on a strategy for which cards to hold, such as holding a pair. The slot server 200 then analyzes the votes and implements the strategy having the highest votes. If the resulting hand is a winning hand, the team players are awarded the resulting payout. Team players can consult with one another, to increase player interaction and permit team players to receive the input and experience of all the other team players towards achieving a payout.

According to various embodiments of this invention, team players may communicate with one another during the course of play. For instance, each team player's slot machine may contain a microphone and speaker. A team member may speak into the microphone of his slot machine. The slot machine may then transmit audio to other team players' slot machines via the slot network. The speakers of the other team players' slot machines may then broadcast the first team player's message. According to various embodiments, team players may also communicate via text or symbolic messages keyed into their respective slot machines using a standard "qwerty" keyboard, or any other buttons or keys. Team players may also key or write messages into their slot machines using the display screen of the slot machine. Communication among team players may allow team players to provide hints and advice to each other on any games requiring decisions. Communication may also allow team players to cheer each other on, to congratulate each other, to console each other, and so on.

Printed Records

In various embodiments, the slot server may properly track and provide payouts/rewards for team play using printed records of the play of each of the team members. Two or more members of a team may first engage in individual play at their own respective gaming devices. Later, the two or more members of the team may each print out a record of their game play. For example, a team member may hit a "print game record" button on his gaming device. The gaming device may then print a list of the last one hundred outcomes achieved by the team member (or any other number of outcomes). Outcomes may be printed in a number of forms, including: (i) text descriptions (e.g. "cherry-bell-bar)"; (ii) abbreviations (e.g., "c-bl-br" for "cherry-bell-bar"); (iii) graphically (e.g., with graphical depictions of symbols comprising the outcomes); (iv) in machine readable form, such as in barcode form; and so on. Of course, outcomes may be printed in several forms, such as in text form and machine-readable form, at the same time. In some embodiments, only certain information pertaining to an outcome may be printed, such as the outcome's payout. Outcomes may be printed using a cashless gaming receipt printer attached to or in communication with a gaming device. Alternatively, outcomes may be printed using any other printer attached to or in communication with the gaming device or slot server (which may store information about the outcomes received from the gaming device).

Once two or more team members have printed out records of their play, the records may be taken to a chip cashing desk, casino booth, or other redemption area. A casino attendant may then examine the game records of each player and determine whether the one or more of the players are due a payment or other prize as a result of team play. For example, in some per-spin embodiments, each of two members of the team is to receive the highest payout achieved by either team member on a given handle pull. Accordingly, the casino attendant may examine the records of the two team members' play side by side. The casino attendant may start with the earliest outcome listed on either player's printed record. If one of the outcomes has a higher corresponding payout than the other, then the casino attendant may pay the difference to the player with the lower-paying outcome. For example, if a first team member had achieved an outcome paying five coins, and the second team member had achieved an outcome paying three coins, then the second team member may be given two additional coins. Presumably, the second team member has already received three coins payout from his gaming device. However, in some embodiments, team members receive no payouts at their gaming devices, and receive all payouts due to them during the redemption process. Continuing with the present example, the casino attendant may now examine the second outcome listed on each of the team members' printed records. Once again, if one team member achieved a payout higher than that achieved by the other, the team member with the lesser payout may be paid the difference. This process may continue until the casino attendant has examined the entire record. It will be appreciated that the casino attendant may refrain from providing any moneys or payouts to team members until the entirety of both records have been reviewed. In this manner, the casino attendant avoids having to make many small payouts, and can instead make one net payout to each team player at the end of the examination process.

In various embodiments, the process of examining a printed record of team outcomes may be automated. For instance, team members may each insert printed records of their outcomes in a kiosk. The kiosk may determine the outcomes achieved by the team members through scanning machine-readable portions of the submitted records. The kiosk may also be operable to provide payouts to one or both of the team members as necessary (e.g., via a cashless gaming receipt printer).

In various embodiments, a first team member may submit a printed record of his outcomes to the gaming device of a second team member. The gaming device may compare the printed record of the first team member with a stored (e.g., in memory) record of outcomes achieved by the second team member. The gaming device may accordingly determine payouts due to the first and/or second team members. Thus, in these embodiments, a gaming device may serve as a redemption device. If the same gaming device has also generated outcomes for a team member already, then the gaming device need not print out a record for that team member as the gaming device may already store a record of the team member's outcomes.

In various embodiments, a team member must agree in advance to have a certain number of outcomes count towards team play. For example, a team member might say that he wants his next two hundred outcomes to be eligible for team payouts (e.g., where each team member receives the highest payout achieved by any team member on a given handle pull). The team member may, for example, navigate a series of menus on the screen of his gaming device in order to first select team play and then a number of handle pulls applicable to team play. At the conclusion of the generation of the next two hundred outcomes, the gaming device may automatically print for the team a record of the two hundred outcomes.

Advanced notice of participation on a team may provide several advantages for a casino. First, as team play may result in certain extra payments going to a team, the gaming device may need to adjust its payout table accordingly in order to maintain a house advantage. For example, if on top of a standard pay schedule, a player could also receive payouts when his teammate achieved a high payout, then a player could conceivably make a profit from team play. Therefore, a gaming device may use an altered standard pay schedule when the gaming device is additionally being used for team play.

Advanced notice of participation on a team may also prevent players from declaring that their outcomes are to count towards team play after the outcomes have already been generated. For example, if two players have been playing at two different gaming devices, and one has had a string of good outcomes, then both may decide to use their last one hundred outcomes as part of a team result, in which now both players would get the benefit of the string of good outcomes. If players were to declare their intentions in advance, then they would not be able to pick and choose favorable times during which team play is to apply, as they would be unaware of the outcomes the future would bring.

One further requirement for team play may be that members of a team initiate team play at their respective gaming devices at approximately the same time. Otherwise, a first player might initiate team play at a first gaming device. Then, the second team player might initiate team play at a second gaming device only if the outcomes of the first player were favorable. Thus, printed records of outcomes may include a time stamp, such as an indication of the time at which team play was initiated. Two or more players may then be awarded a team prize or payout only if the initiation of team play at their respective gaming devices occurred at approximately the same time (e.g., within one minute of each other). In some embodiments, the players may be required to initiate corresponding handle pulls within a predetermined time of one another. For instance, the seventeenth handle pull of a first team player must be initiated at approximately the same time as the seventeenth handle pull of a second team player. These embodiments provide added protection against a first team member finishing a session while a second waits to see if the first player has done well or not.

Thus, in one or more embodiments, two team players may indicate at their respective gaming devices a desire to engage in team play. The two players may then independently generate outcomes at their respective gaming devices in standard fashion (e.g., by inserting currency, pulling the handle, etc.). At the conclusion of a period of team play, each player may print out at his respective gaming device a record of the outcomes generated during the period of team play. The records may include a time stamp indicating the time period during which team play occurred. The records may in fact include multiple indications of time, including a beginning of the period of team play, and end to the period, and indications of when one or more of the individual outcomes generated during the period were generated. A redemption device, such as a kiosk, may then compare the printed records for the two team members and provide a payout based on certain rules applicable to team play.

In some embodiments, team members may have the opportunity to retroactively declare that a certain outcome or handle pull applies to team play. For example, two team members are playing at adjacent gaming devices. A first of the team members makes a handle pull. The second of the team members then makes another handle pull within three seconds of the first. The first team member obtains the outcome "bell-bell-bell," with an associated payout of twenty coins. The second obtains the outcome of "plum-bar-bell," with an associated payout of zero coins. The two team members then decide to declare the last handle pull for each as being part of team play. Accordingly, the second team member receives a payout of twenty coins, the difference between what the first team member has already received, and what the second has already received.

Since it may be beneficial to retroactively declare team play for a certain outcome or handle pull, one or more team members may pay in advance for the privilege of later making a retroactive declaration. For example, suppose two players are each playing at adjacent gaming devices. They decide to each insert ten coins into their respective gaming devices to purchase a privilege of retroactively declaring team play for one handle pull of the next one hundred handle pulls. Subsequently, for one hundred handle pulls, if both team members decide to retroactively declare team play for a given handle pull, then the two players (or the appropriate player—such as the player who received the lesser payout during the given handle pull) will receive a team payout based on the result of the given handle pull. For example, suppose that on the seventy-first handle pull one player receives a payout of eighty coins, and the other player receives a payout of twenty coins. The players may each then retroactively declare the pull to be a team handle pull, after which the player who received twenty coins will receive an additional sixty (eighty minus twenty equals sixty). In various embodiments, the players may complete the entire one hundred handle pulls over which the privilege applies. The players' gaming devices (or the slot server) may then automatically determine the handle pull to which team play would most favorably apply. For instance, the slot server may choose the handle pull from the last hundred handle pulls during which the players had the greatest difference in payouts.

It will be appreciated that a privilege to retroactively apply team play may extend to as few as one handle pull, or to any desired number of handle pulls. For example, team members may purchase a privilege to retroactively apply team play to up to five handle pulls within the next hundred. It will also be appreciated that a privilege may remain in effect for any number of handle pulls besides the one hundred handle pulls described in the example above. It will also be appreciated that team members may have to make a decision to retroactively apply a handle pull immediately following the handle pull, or that team members may be able to wait, e.g., until the last handle pull has been completed in which their privilege applies. In various embodiments, a privilege to retroactively apply team play may extend to a time period.

To purchase a privilege, one or more players on a team may navigate appropriate menus on the display screens of their gaming devices, or may press appropriate buttons or areas of a touch screen with such labels as "purchase retroactive team privilege." To exercise a privilege, one or more team members may also navigate menus or press appropriate buttons or areas on their gaming devices. For example, one button may be labeled "make last pull a team pull."

In one or more embodiments, whether or not an outcome or handle pull counts towards a team result may be determined randomly. For example, after a team player initiates a handle pull, but before the outcome of the handle pull is determined, the handle pull may randomly be determined to count towards team play. If the handle pull is determined to count towards team play, then the one or more players on the team may receive a payout based on the subsequently determined outcome of the handle pull.

In some embodiments, the respective gaming devices for each respective player on a team make random determinations as to whether or not the subsequently determined outcomes will count towards team play. If each of the gaming devices makes the determination that the subsequent outcome that it generates will count towards team play, then a team result may be determined based on the outcomes generated at each of the gaming devices.

For example, Joe is playing on gaming device A, and Sue is playing on gaming device B. Joe and Sue each initiate a handle pull at about the same time. After Joe initiates his handle pull, gaming device A determines that Joe's handle pull will count towards team play. Similarly, after Sue initiates her handle pull, gaming device B determines that Sue's handle pull will count towards team play. Joe's gaming device subsequently generates an outcome payout of five coins, and Sue generates an outcome paying eight coins. Joe is then awarded his payout of five coins, plus three extra coins (the difference between Sue's payout and Joe's original payout). Sue, meanwhile, receives her payout of eight coins.

However, suppose in a second instance that Joe initiates a handle pull and gaming device A determines that it will count towards team play. Suppose further that Sue initiates a handle pull at about the same time, but gaming device B determines that the handle pull will not count towards team play. Then team play will not apply to the outcomes generated in the second instance, since all gaming devices have not determined team play to be in effect. Therefore, in various embodiments, all gaming devices used by the members of a team must "agree" that their respective outcomes are to count towards team play in order for a team result to be generated. However, it will be appreciated that, in some embodiments, only a majority of team members' gaming devices may need to "agree" in order for the outcomes of all team members to count towards a team result. It will also be appreciated that only a predetermined number or percentage of team members' gaming devices need "agree" in order for the outcomes of all team members to count towards a team result.

In various embodiments, the gaming devices of various team members may not independently determine whether a subsequently generated outcome will count towards team play. Rather, the decision may be coordinated so that all gaming devices come to the same determination. For example, the slot server may randomly determine whether the outcomes of a group of gaming devices are to count towards a team result. The slot server's determination, whether affirmative or negative, may then be communicated to the appropriate gaming devices. The gaming devices may then display the determination to their respective players. For example, a display may read, "This spin counts towards team play. Good luck!" Of course, a gaming device may display whether or not an outcome will count towards team play regardless of where or how the determination was made.

In various embodiments, the determination of whether or not an outcome will count towards team play may be made after the outcome has been determined (e.g., after a set of symbol indicia have been determined), or may be made at about the same time that an outcome is being determined. In embodiments where the determination is made afterwards, the determination may be made significantly afterwards. For example, after two team members have each completed fifty handle pulls, a slot server may determine randomly that the twelfth handle pull of each player counts towards team play. Accordingly, a team result may be determined based on the outcomes generated by each of the two team members during their respective twelfth pulls. In these embodiments, if there is a particular handle pull during which a team result would be favorable (e.g., during which the team or a player on the team would receive a significant payout based on the team result), then team members may hope that the particular handle pull would subsequently be determined to count towards team play.

It should be noted that, in various embodiments, a team outcome may be determined based on an $m^{th}$ pull made by a first player on a team and an $n^{th}$ determined based on the twelfth handle pull made by the first player, and based on the twentieth handle pull made by the second player.

Virtual Tournaments

In various embodiments, virtual tournaments are possible, with a plurality of teams competing against one another for the highest team session result. According to various embodiments, all or a portion of the team session results could be displayed to a team player participating in the tournament. For example, a player could view his own team's result, as described above, in addition to the team results of the top five teams. Alternatively, or in addition, the results of individual players participating in the tournament could be displayed.

In one or more embodiments, two or more players on a team may be issued a single "team tracking card." The team tracking card need not be "single" in the sense that there is only one physical card. Rather, each of the two or more players may receive separate copies of the card. However, each of the cards may share common features, such as a common identifying number, common text, or common markings.

When any player has a copy of the team tracking card inserted into a gaming device, play at the gaming device may be credited towards team comps. For instance, suppose player A and player B are part of the same team. Each is using a separate copy of the team tracking card, and each is at a separate gaming device in which one comp point is awarded per handle pull. Suppose that player A makes thirty handle pulls in a given period of time, and player B makes twenty-five handle pulls in the same period of time. Then, the team comprising player A and player B may be awarded fifty-five comp points due to the actions of player A and player B during the given period of time.

Conventional player tracking card systems associate comp points with individual players. For instance, a conventional comp system may include a database in which is stored in one field a player name, and in an associated field a number of comp points belonging to the player. However, the present invention envisions a comp system in which comp points are associated with groups, or teams of players. Accordingly, a comp system of the present invention may include a database in which are listed team names in one field, and associated comp points in an associated field. Each time one player on the team uses the team tracking card to accumulate comp points, such comp points may be added to the team's total, as stored e.g., in a database listing teams and associated comp totals.

Various embodiments of the present invention include tracking cards that are not associated with a particular player. Thus, when a player uses a tracking card of the present invention, such as a team tracking card, comp points may be awarded to the team as a whole and not to the individual player.

As used herein, the term "entity" may refer to an account from which a plurality of people may draw, and/or to which a plurality of people may contribute. Thus, an entity may include an account of comp points corresponding to the members of a team. Comp points may be earned by one or more members of the team and added to the account.

Similarly, one or more members of the team may use comp points stored in the account in order to obtain benefits, such as meals.

Thus, in various embodiments, a slot server may receive an indication that a first number of comp points has been earned. The comp points may have been earned by a member of a team, for example. The slot server may then award the first number of comp points to an entity, such as an account associated with the team. Note that comp points that have been earned may be comp points that are due to be awarded. The comp points may be due to be awarded, for example, as a result of a predetermined amount of play or other wagering activity performed at a casino. In some embodiments, an indication that a comp point has been earned may include an indication that at least one play has been completed at a gaming device.

In embodiments described above, comp points may be earned by a first player and then awarded to an entity. Subsequently, additional comp points may be earned by a second player. The additional comp points may also be awarded to the entity. The first player and the second player may be teammates, for example.

In some embodiments, awarding comp points to an entity may include accessing a database record corresponding the entity and updating a field in the record to reflect a new number of comp points associated with the entity. For example, a casino may maintain a database in which each record describes an entity and a number of comp points associated with the entity. The description of the entity may include a list of player names associated with the entity. Such players may earn comp points that are awarded to the entity.

In various embodiments, a tracking card may be associated with both a team and with an individual player. For example, suppose player A is on the "Connecticut Girls" team. When player A makes a handle pull on a gaming device that awards two comp points per handle pull, player A may be credited with one of the two comp points, and the Connecticut Girls team may be credited with the other of the two comp points. It will be appreciated that many possible divisions of comp points between an individual and a team are possible. For example, every third comp point awarded due to an individual's play may be credited to a comp account associated with the individual, while the remainder of the comp points may be credited to a comp account associated with the individual's team.

Thus, in various embodiments, a slot server may determine a first number of comp points that have been earned by a player at a gaming device. The slot server may determine a team with which the player is associated. The slot server may then provide a second number of comp points to the player. For example, the second number of comp points may be half the first number of comp points. The slot server may then provide a third number of comp points to the team (e.g., to an account associated with the team). The third number may be, for example, the portion of the first number that was not provided to the player. Thus, the sum of the second number and the third number may equal the first number. In particular, however, the sum of the second number and the third number does not, in various embodiments, exceed the first number, as then the slot server would be providing more comp points than have been earned.

Team tracking cards allow members of a team to contribute comp points to a team. As such, team members may experience social pressure from other team members to play using the team tracking cards, so that the team as a whole benefits. Therefore, the use of team tracking cards may encourage greater play at a casino.

In some embodiments teams may designate charities or other organizations to benefit from comp points earned by team members. Thus, when a team tracking card is inserted into a gaming device, one or more comp points earned at the gaming device may be associated with a charity designated by the team. For example, the slot server may maintain a database where each record lists a team, a name of a charity, and a number of comp points earned by the team that are to benefit the charity. When a certain number of comp points have been earned for a charity (either by one team, or multiple teams), the casino may provide the charity with a benefit. The benefit may take the form of cash, services (e.g., repairs to an orphanage), goods (e.g., books for a library), and so on. The casino may also provide the benefit to the team that earned the comp points. The team may then provide the benefit to the charity. The present embodiments may encourage members of an organization (such as a house of worship), or members believing in a common organization, to play as a team in order to help the organization.

In various embodiments, team tracking cards may take on a customized team appearance. For example, each copy of a team tracking card may be colored purple and orange, the team colors. A different team may have a card printed in different colors. Each copy of the team tracking card may also include the team name and/or an identifier associated with the team. Such an identifier may include a number or other alphanumeric sequence.

Comps that have been earned by a team may be redeemed by one or more team members. For example, one or more team members may present their team tracking cards at a casino restaurant in order to receive a complimentary meal. In various embodiments, a predetermined number or percentage of team members must be present in order for comps to be redeemed. For example, two team members, each bearing a copy of the team tracking card, may be required in order for comps to be redeemed. This may prevent a single team member from inequitably receiving comps that should rightfully be distributed among all the team members.

Teams may be structured such that only one player may earn comps for a team account, and any player on the team may redeem the comp points from the team account. As used herein, the term "redeem" when used in reference to a comp point may include exchanging a comp point or comp points for the privilege of performing one or more activities. Comp points may be redeemed for various activities, such as for obtaining free meals, for obtaining free or discounted show tickets, for obtaining free hotel rooms, and so on. Thus, in various embodiments, a slot server may receive an indication that one player has earned a number of comp points. The slot server may then increment an account, such as a team account, based on the number of comp points earned. The slot server may then decrement the account based on activities of a plurality of players, such as based on activities of other players on the team. The activities may include activities by the one player who has earned the comp points for the team.

A team may be structured so that a plurality of players may earn comp points for the team, but such that only one player may redeem the comp points of the team. Thus, in one or more embodiments, a slot server may receive an indication that a plurality of players have collectively earned a number of comp points. The plurality of players may represent the members of a team, for example. The slot server may then increment the account based on the number of comp points earned by the plurality of players. The one player who may redeem the comp points may later redeem the comp points to perform some activity, such as to acquire a free meal for the team. Accordingly the slot server may decrement the account based on the activities of only one player. Note that the one player may be on the team.

A team may be structured so that a plurality of players may earn comp points for the team and a plurality of players may redeem comp points associated with the team. Thus, in some embodiments a slot server may receive an indication that a plurality of players have collectively earned a number of comp points. The plurality of players may be members of a team, for example. The slot server may increment an account based on the number of comp points. For example, the account may be associated with the team. The slot server may then decrement the account based on activities of the plurality of players. For example, the slot server may decrement the account based on lunches received in return for comp points.

In various embodiments, a person at a first gaming device may receive comp points from play at a second gaming device. For example, the person may have a single tracking card inserted into the first gaming device, and yet may receive comp points based on play at the second gaming device, where the second gaming device is different from the first gaming device. Of course, the person may also receive comp points from play at the first gaming device (where his tracking card may already be inserted).

In these embodiments, a person with a single tracking card may play multiple gaming devices and may receive comp points from all of them. For example, a person may insert his tracking card into one gaming device, and may then designate an adjacent gaming device as one from which he would like to receive comp points for his play. Having inserted a tracking card into a first gaming device, a person may designate a second by any one or more of: (i) entering into the first gaming device an identification number of the second gaming device (e.g., a number displayed on the housing of the second gaming device); (ii) designating a relative location of the second gaming device in relation to the first (e.g., designating the gaming device to the right or to the left of the first gaming device); (iii) indicating the type of game featured on the second gaming device (e.g., "Monopoly®", "Wheel of Fortune®", etc.); (iv) indicating a location of the second gaming device relative to other fixed landmarks (e.g., relative to prominent structural features of the casino, such as a wall, post, or exit—"the first gaming device in the row three rows away from the back wall of this room"); and so on. Once a person has designated one or more gaming devices in addition to the first gaming device, the person may commence play at all the gaming devices and may receive comp points for this play at all the gaming devices.

As used herein, a gaming device "contains" a tracking card when a tracking card has been inserted into the gaming device and has not subsequently been withdrawn from the gaming device. A gaming device that contains a tracking card may derive information from the tracking card, such as a name of the card's owner. The gaming device may derive information from a tracking card by e.g., reading information magnetically encoded on a magnetic strip of the tracking card. In various embodiments, a person may receive comp points based on play at a gaming device that does not contain a tracking card.

As described above, various embodiments may include the following steps. A slot server may receive an indication that a tracking card is inserted into a first gaming device. The slot server may receive from the first gaming device an indication of a selection of a second gaming device, in which the second gaming device does not contain a tracking card. For example, a player who has sat down at a first gaming device and inserted his tracking card may select the second gaming device from the first gaming device. The slot server may receive an indication that a number of comp points has been earned for play at the second gaming device. For example, the player may engage in various wagering activities at the second gaming device in order to earn comp points. The slot server may then award the number of comp points to an account associated with the tracking card. The account may belong, for example, to the player.

In various embodiments, a person may attempt to designate gaming devices that are already in use by unrelated players. The person may thus unfairly attempt to receive comp points based on the play of others. Accordingly, in various embodiments of the present invention, a second gaming device that has been designated from a first gaming device may display a confirmation screen. The confirmation screen may display a message such as:

"Mr. Tom Anderson has designated this slot machine as one that he is playing. Please confirm by pressing YES if you are Tom Anderson. If you are not Tom Anderson, please press NO."

If the designated gaming device is already occupied by an unrelated player, the player will most likely press NO, after which Tom Anderson will be unable to receive comp points based on play at the second gaming device. However, if the second gaming device is unoccupied, then Tom Anderson may go to the second gaming device and press YES to indicate that he will in fact be playing the second gaming device.

Thus, a person with a single tracking card may receive comps from play at multiple gaming devices. Various embodiments also allow a team to receive comp points from play at multiple gaming devices where there is only a single team tracking card. For example, three team members may sit down at three adjacent gaming devices. The team member in the middle may insert a team tracking card into his gaming device. The middle team member may then designate the gaming devices to his left and right (those occupied by his fellow team members), such that play at the designated gaming devices will provide comp points to the team as a whole. Therefore, the team as a whole may receive comps based on the play of three different team members, even though there is only a single copy of a team tracking card in use. It will be appreciated that the present embodiments may extend to cases where there are multiple copies of a team tracking card in use, but where there are more team members playing than there are copies of the team tracking card in use. For example the holder of one copy of the tracking card may designate first and second gaming devices to provide comps to the team, while the holder of another copy of the tracking card may designate third and fourth gaming devices to provide comps to the team.

In various embodiments, two or more team members may jointly participate in a bonus round of a gaming device.

To begin with, each of two or more team members may enter a bonus round when one of the team members achieves a predetermined outcome. For example, one of the team members may achieve three special symbols on the reels of his gaming device. Alternatively, the two or more team members may, amongst the group, achieve enough of a special symbol to trigger a bonus round. For example, on a two-person team, a first member may achieve one of special symbol, and a second member may achieve two more of the special symbol, such that three special symbols have been achieved between the two team members. The two team members may then jointly enter a bonus round.

Thus, in various embodiments, a first team member at a first gaming device may achieve an outcome sufficient to enter the first team member and another player on the team into a bonus round. The slot server may receive an indication that the first team member has achieved an outcome providing entry into a first bonus round for both the first team member and another team member. The slot server may thereupon determine a second player at a second gaming device, in which the second player is on the same team as the first team member. For example, the slot server may poll various gaming devices on the casino floor for the identities of players at the gaming devices. The slot server may compare the identities to a list of players on the same team as the first team member. If the slot server determines that a player at a gaming device on the slot floor is on the same team as the first team member (e.g., because the name of the person at the gaming device matches the name of a person on the same team as the first team member), then the slot server may determine that the person is a second team member who will jointly participate in the bonus round with the first team member. The slot server may then transmit instructions to the second gaming device of the second team member, instructing the gaming device to provide entry into a second bonus round for the second team member. The gaming device of the second team member may then communicate with the gaming device of the first team member in order that the two gaming devices may render a coordinated bonus round in which both team members are involved. In some embodiments, the first team member and the second team member may play separate bonus rounds on their respective gaming devices, such that the bonus rounds unfold independently of one another.

In various embodiments, as described above, a slot server or other device may perform the following steps. The slot server may determine a type of symbol required for entry into a bonus round. The slot server may determine a threshold number of such symbols required for entry into the bonus round. For example, four "super-bonus" symbols are required for entry into the bonus round. The slot server may then receive an indication of a first number of the type of symbol obtained by a first player at a first gaming device. For example, the first player may obtain three "super-bonus" symbols. The slot server may then receive an indication of a second number of the type of symbol obtained by a second player at a second gaming device. For example, the second player may receive two "super-bonus" symbols. The slot server may then determine a sum of the first number and the second number. To use the above examples, the sum yields a total of five "super-bonus" symbols. The slot server may then determine whether the sum is not less than the threshold number of symbols. Continuing with the above example, the five symbols obtained is not less than the threshold number of four symbols. The slot server may then instruct, based on the sum not being less than the threshold number of symbols (e.g., if the sum is not less than the threshold number of symbols), the first gaming device to provide entry for the first player into the bonus round at the first gaming device.

As is well-known in the art, a bonus round may be a game played at a slot machine that goes beyond the routine spinning of reels and the routine generation of outcomes. A bonus round may involve a story, special graphics, special characters, selections from a player, and so on. For example, a bonus round may include a depiction of a jungle scene in which an animated monkey swings from tree to tree, grabbing fruit. Each piece of fruit grabbed by the monkey may confer winnings upon the player in the bonus round. It should be noted that a bonus round is typically a desirable place to be for a player as a player typically receives a relatively large payout from a bonus round with little risk.

In various embodiments, an action by a first team member in a bonus round may be reflected on the screen of the gaming device of a second team member. For example, a first team member may pick a first door to open in order to reveal a hidden prize. The display screen of the second team member's gaming device may (in addition to the first player's screen) show the door opening and show a prize behind the door.

In various embodiments each of two or more team members may make a decision while participating in the same bonus round. For example, two team members may be in a bonus round together in which there are three doors. Each door may have a hidden prize behind it. A first team member may have the opportunity to choose one door to open. The second team member may then have the opportunity to choose a second door to open. The second team member may base his choice on the first team member's choice in that the second team member may make a choice other than that made by the first team member. That is, the second team member may avoid choosing the door that has already been opened by the first team member. Alternatively, the second team member may be prevented from repeating the choice of the first team member.

In various embodiments, two or more team members may each initiate the generation of a random result in a bonus round. For example, a bonus round may include the spinning of a wheel whose final position determines a payout to one or more of the team members. During the same bonus round, a first team member may have the opportunity to initiate the spinning of the wheel, and a second team member may have a separate opportunity to initiate the spinning of the wheel. Thus, for example, each team member may receive at least two payouts in the bonus round, one payout for each spinning of the wheel.

In various embodiments, a first team member may initiate an action, and a second team member may stop the action. For example, in a bonus round, a first team member may press a button that initiates the spinning of a wheel. A second team member may press a button that halts the spinning of the wheel. Likewise, in an ordinary spin of the reels of a slot machine, where the slot machine is being played by two team members, a first team member may provide a first input to initiate the spinning of the reels, and a second team member may provide a second input to halt the spinning of the reels. Based on the first input and the second input, an outcome comprising a plurality of indicia may be determined. The outcome may be based on symbols generated at a slot machine played by both players. In various embodiments, a first team member may play a first slot machine and a second team member may play a second slot machine. The outcome may then be based on symbols generated on the reels of both of the first and second slot machines. In the various embodiments described above, two team members may then feel that each has exerted some control over the final outcome of the wheel, the reels, or of the particular action in question.

In various embodiments, each of two or more team members participating in the same bonus round may make a decision or may initiate the generation of a random result. The best decision or the best random result may then be counted towards the team's progress in the bonus round. As a first example, suppose three team members are playing in the same bonus round. The bonus round involves the spinning of a wheel to generate a payout. In this example, each of the three team members spins the wheel once. The highest payout resulting from the three spins of the wheel will then be paid to each team member. Thus, if team member one spins the wheel to land on ten coins, team member two spins the wheel to land on thirty-five coins, and team member three spins the wheel to land on twenty coins, then each of the three team members gets a payout of thirty-five coins (or alternatively thirty-five coins added to their running tallies of winnings in the bonus round).

As a second example, suppose three team members are playing in the same bonus round in which a single character must be advanced around a game board. Each of the three team members may initiate the rolling of a simulated pair of dice. The game character will then advance on the game board a number of squares equal to the highest of the three rolls of the dice.

As a third example, suppose two team members are playing in the same bonus round in which prizes are hidden behind doors. A first of the two team members may pick a first door to reveal a first prize (e.g., a first payout amount). A second of the two team members may then pick a second door to reveal a second prize (e.g., a second payout amount). Both team members may then receive the better of the two prizes (e.g., the highest of the two payout amounts). Alternatively, the team as a whole receives the better of the two prizes. It will be appreciated that there are many other circumstances in which the best decision from among multiple team members, or in which the best result from among multiple team members may be applied to each or every team member, or to the team as a whole.

In various embodiments, the best net result of a team member may be applied to one or more other team members. For instance, two team members may each play the same bonus round in which they each make a series of decisions (e.g., each picks a series of doors to reveal prizes, or each makes a series of roles of the dice in order to have a representative game character traverse a game board). During the course of the bonus round, each team member may maintain his or her own separate tally of accumulated credits or payout amounts. At the end of the bonus round, each team member may receive the highest of the tallies accumulated by any team member.

In various embodiments, each of two or more team members may be represented by separate characters or entities in a bonus round. For example, each of two team members may be represented by a separate character that traverses a common game board in a bonus round. The game characters may aid one another throughout the course of a bonus round. For example, a first game character may land in a "dungeon" on the game board, causing the game character to become imprisoned and ineligible for further turns or plays in the bonus round. However, a second game character may land on an area of the game board that allows him to "rescue" the first game character from the dungeon. After being rescued the first game character will be eligible for future turns or plays in the bonus rounds.

Thus, in one or more embodiments, a first action taken by a first team member in a bonus round may effect the actions that a second team member is eligible to make. A first action by a first team member in a bonus round may effect whether a second team member is eligible to take any action at all. In the prior example, by rescuing the first game character (i.e., the first team member's character) from the dungeon, the second team member allowed the first team member to take further actions he otherwise would not have been able to take.

Embodiments in which one team member is allowed to rescue or otherwise aid another may create excitement for team players, as well as a good deal of camaraderie. If one team member gets in trouble, he can cheer for the other team member and hope to be rescued.

In one or more embodiments, two or more team members may participate in a common bonus round in which each must make decisions about which door to open, which box to open, which grave to dig up, or which of any number of other possible selections to make in order to reveal a hidden prize. Some selections may lead to prizes, while other selections may lead to a game character's elimination from the bonus round. For example, if a game character opens a door with a skull and crossbones symbol, the game character may be eliminated from the bonus round. In some embodiments, if a first team member (i.e., his character) is eliminated from a bonus round for making an inopportune choice, a second team member may have the first team member restored by making another choice that reveals a "restore" or "redeem" or other such symbol or result. The first team member may then continue to play in the bonus round. If the second team member is later eliminated, then the first team member may have the opportunity to return the favor.

In some embodiments, a first team member may be eliminated from a bonus round (e.g., after obtaining three of an elimination symbol or result). However, a second team member may remain in the bonus round. The first team member may ultimately receive the benefit of the second team member's final result in the bonus round. For example, if a first team member is eliminated from a bonus round after accumulating twenty-three credits, and a second team member lasts in the bonus round until he has accumulated fifty credits, then the first team member may receive a payout of fifty credits. The second team member may also receive fifty credits. Alternatively, the two team members may divide the fifty credits amongst them. The division may be equal, or the second team member may receive the larger portion for having been the one to last longer. In some embodiments, both team members may receive some combination of the results of both team members. For example, both the first and second team members may receive 50+23=73 credits, the sum of the two team members' results. In any event, if a first team member is to benefit from the results of a second team member, then the first team member may cheer for the second even after the first has been eliminated from the bonus round. Team camaraderie may result.

In various embodiments, a bonus round may consist of various stages. For example, in a first stage, a team of players must reveal three prize symbols hidden behind various doors before two lose symbols, also hidden, are revealed. If the doors hiding the three prize symbols are successfully chosen, then the players may advance to a second stage of the bonus round. In the second stage, for example, prizes may correspond to greater payouts. Further, players may be presented with a new set of doors and a new challenge to reveal a first predetermined number of prize symbols before a second predetermined number of lose symbols are revealed.

In one variation, each player may be eliminated individually from a common bonus round. For example, a stage of a bonus round may consist a grid of opaque symbols hiding either prize symbols or lose symbols. Team players may take turns picking opaque symbols in order to reveal the hidden symbols beneath. When any team member accumulates three lose symbols, then that team member may be eliminated from the bonus round. However, the other team members may remain in the bonus round and may continue to pick opaque symbols. When the team as a whole has accumulated a certain number of prize symbols (or has met some other criteria for continuing), then the team may advance to the next stage of the bonus round. At this next stage, any team members who were previously eliminated may be brought back into the game. In this way, a team member need not feel too badly if he is eliminated during one stage, because he may later be brought back if a teammate advances to the next stage.

In various embodiments, a slot server may receive a first input from a first player at a first gaming device. The first input may be, as described above, a choice made by the first player (e.g., a choice of a door to open in order to reveal a hidden prize) or the initiation of a random outcome. The slot server may then receive a second input from a second player at a second gaming device. The second player and the first player may be on the same team. The slot server, or the first or second gaming device, may determine a first state of the game based on the first input of the first player. As used herein, a state of a game may include data that characterizes relevant parameters of a game at a particular point in time. For example, a state of a game may include a position of a game character on a game board, a number of pulls remaining in the game, a number of "missteps" allowed before the game ends, a number of credits or points won so far in the game, and so on.

To determine a first state, the slot server may, for example, receive from the first player an input that initiates the rolling of simulated dice. The numbers revealed by the dice may determine a number of spaces that a game character advances on a game board. Thus, a first input of the first player may be used to determine a first state in which the first state includes a position of a game character on a game board. In another example, the first player may provide an input that includes a choice of a location from which to reveal a hidden prize. The slot server may reveal the prize and credit the prize value to the first player (and/or to team members of the first player, such as the second player). The slot server may thereby determine a first state of a game in which the first state includes a number of credits won by the first player, and a particular location whose hidden prize has already been revealed. As will be appreciated, many other inputs by the first player may lead to various other states of a game.

In a similar manner, the slot server (or the first gaming device or the second gaming device) may determine a second state of the game based on the second input from the second player. For example, the first player may initiate a first roll of simulated dice in order to advance a game character along a game board, resulting in a first state of the game. The second player may then initiate a second roll of simulated dice in order to further advance the same game character along the game board, resulting in a second state of the game.

The slot server (or the first or second gaming device) may instruct the first gaming device to display the first state of the game to the first player. A display of a state of a game may include, for example, a graphical depiction of a game character on a game board, a text representation of a number of credits won so far in the game, a text description of a number of pulls remaining in the game, and so on. The slot server may likewise instruct the second gaming device to display the first state of the game to the second player. Since the second player may be involved in the same game as the first player, it is natural that the second player would want to remain visually appraised of the state of the game.

Ultimately, the game may come to a conclusion based on the various inputs provided by the first and second players, and based on intermediate states during the game. Accordingly, the slot sever may determine a final state of the game based on at least one of the first state, the second state, the first input provided by the first player, and the second input provided by the second player. The slot server may determine first compensation for the first player based on the final state. For example, if the final state includes a number of credits accumulated during the game, the first player may be awarded the number of credits. In some embodiments, the first player is awarded half the number of credits, with the other half going to the second player. Likewise, the slot server may determine second compensation for the second player based on the final state.

In one or more embodiments, team members may vote on an action to be taken in a game on a gaming device. Such a game may include a bonus round. For example, the members of a team may be playing in a common bonus round in which the team members as a group must decide which of several doors to open in order to reveal a hidden prize. Each team member may vote on the door to be opened by touching one of three locations on the display screen of his/her gaming devices. For instance, the display screens of each of the players may display the same image of three doors. Each player may then cast his vote by touching either the left door, the middle door, or the right door. The votes cast by each team member may be tallied, for example, by the slot server. The door receiving the most votes may then appear to open on the display screens of each of the team members, and the team may receive a payout or other prize based on what is revealed by the door.

In various embodiments members of a team may vote on strategies to be used in other games. For example members of team may vote on a strategy to be used in video poker. In games involving risk, team members may vote on the amount of risk to take. For example, various bonus rounds may allow a team to quit a game with a certain amount of winnings, or to press on with the chance of greater winnings, but with a risk of losing the existing winnings. The team members may vote on which two courses of action to take. In addition, players may play ordinary games, such as spinning the reels of a slot machine, as a team. The players may vote on how much to wager on the games.

In various embodiments, if players vote on a course of action, and there is a tie vote, the slot server may break the tie in various ways. For example, the slot server may randomly choose a course of action in a game, or may randomly choose a course of action from among those receiving the highest number of votes. The slot server may also choose the course of action that is most favorable to the team (e.g., the course of action in a game of video poker with the highest expected value).

In one or more embodiments, the object of a bonus round may be for two or more teammates to find each other. For example, a game character representing each teammate may be placed in some portion of a maze. Through random results generated by the team members' gaming device, or through player decisions, the game characters may move through the maze. If the game characters ever do meet up, then the players may receive a predetermined bonus payout. In some embodiments, players may have an omniscient view of the maze so that they may see their locations in the maze as well as the locations of their teammates. However, in other embodiments, players may have a view as if they were inside the maze themselves, unable to see the larger layout of the maze.

Members of a team may desire to play at adjacent or nearby gaming devices. Ordinarily, it may be difficult for members of a team, especially of a large team to find an empty block of gaming devices. Accordingly, in one or more embodiments, members of a team may reserve a group of gaming devices. To have the gaming devices reserved, the casino or other establishment in which the gaming devices are used may prevent, during the time period specified in the reservation, players other than the team members from occupying the gaming devices that have been reserved. The gaming devices will then be free for the team to use during the reserved time period. A team benefits from being able to reserve a block of gaming devices because it allows them to play together. A casino benefits from the ability to bring a large group of people to play at its devices.

One or more members of a team (e.g., a team leader) may request that a group of gaming devices be reserved. The request may include a time period during which the gaming devices are to be reserved. For example, the time period may be from 5:00 pm to 6:00 pm. Or the request may ask that the gaming devices be reserved from 5:00-5:05 pm, during which the team may simply occupy the gaming devices and then stay as long as they wish. The request may include a deposit, such as a $40 deposit that provides the casino some assurance that the team will actually show up to play the gaming devices. By reserving gaming devices, the casino is potentially losing money since it may have to either remove existing players from the gaming devices, or prevent players from using the gaming devices. If a team does not show up to claim the gaming devices it has reserved, then the casino may keep the deposit. The casino is then somewhat compensated for having to remove players or prevent players from using its gaming devices. If the team does show up and claim the reserved gaming devices, then the casino may return the deposit. The deposit may be returned in the form of cash or may be returned in the form of free handle pulls, or a credit balance on one or more of the reserved gaming devices. For example, a $20 deposit on a reserved gaming device may be returned in the form of a twenty-credit balance (assuming the reserved gaming device is a $1 machine).

A gaming device that is reserved may display a message indicating the times during which it is reserved. The message may appear a predetermined amount of time prior to the reserved period. For example, suppose a gaming device is reserved from 5:00 pm to 6:00 pm. Then, at 4:45 pm, a message may appear on the screen of the gaming device indicating that the current player has ten minutes to finish up after which he will have to leave the gaming device due to a 5:00 reservation. A gaming device that is not currently in use may be "locked" a predetermined period of time prior to the reserved time period, so that others may not play on it.

When a team member arrives at a gaming device that has been reserved for his team, he may insert his player tracking card, his team tracking card, a special team code, or otherwise make it clear that the gaming device has been reserved for him. He may thereby activate the gaming device for play.

In one or more embodiments, when a first member of a team approaches a gaming device and claims it as his (e.g., by identifying himself as part of the team), all other gaming devices reserved in the same block may become active again. The first gaming device may communicate to the slot server that it has been claimed by the reserving party. The slot server may then send a signal to the other gaming devices in the group that they need no longer remain locked. Alternatively, the first unreserved gaming device may communicate directly to the others in the group. When a first gaming device signals a second in a group to become active again, the team member sitting at the second gaming device is spared the trouble of entering a code, inserting a team tracking card or taking other measures required for claiming the reservation. Of course, it will be appreciated that two team members may be required to appear at two gaming devices of a block of reserved gaming devices before the rest are unreserved, or three team members may be required, etc.

In one or more embodiments, a casino may dedicate special resources to a group of people designated as a team. These resources may include a dedicated cocktail waiter/waitress. The waiter/waitress may bring drinks and other refreshments exclusively to members of the team, so that the team is kept happy. The dedication of a waiter/waitress is especially convenient when the group of people has reserved a block of gaming devices at which to play. The waiter/waitress then needs only bring refreshments to a small area within the casino.

A dedicated casino worker, such as a waiter/waitress may become familiar with the food and beverage preferences of team members, and may accordingly provide better service. For instance, a dedicated waiter/waitress may quickly learn that John likes an orange juice every hour, Sam likes a tomato juice every three hours, and so on. A dedicated casino worker could further pass messages back and forth among team members. For instance, a waitress might ask John how he's doing as she brings him his orange juice. When she later brings Sam his tomato juice, she can relay to Sam that John is doing well.

A casino may provide a team with many expedited services. For example, team members may receive expedited hopper fills. In other words, when a number of gaming devices on a casino floor require hopper fills, those gaming devices belonging to team members may receive first priority. One motivation is that keeping one team member waiting may effectively keep the others waiting as well. For instance, if all team members want to go out to dinner, but one is kept waiting by an empty hopper, then all team members must wait for the one team member to get his hopper filled. Thus, in order to maintain good feeling among all members of a team, a casino might expedite service for any of the members that need it. Other expedited services may include expedited check-in to a casino hotel, quicker seating at restaurants, quicker preparation of meals at restaurants, and so on.

Therefore, in one or more embodiments, a casino, slot server, or other representative thereof, may identify one or more members of a team, and may provide dedicated resources to the one or more members based on their membership in the team. Further, a casino may identify one or more members of a team, and may provide better or expedited services to those members based on their membership on the team.

In various embodiments a casino may provide dedicated resources and or expedited services based on the number of people who are on the team. For example, a team gets a dedicated waiter/waitress if there are at least eight players on the team. There may be further requirements for receiving dedicated resources. For example, at least eight members of a team must be actively playing on the casino floor, or at least six members of a team must play for at least an hour per day. Players on a team may therefore be encouraged to remain at a casino, and to play at the casino, so that the team may receive benefits of dedicated personnel, or expedited services.

In various embodiments, a casino may provide a host for teams. A host may be a person that provides such services as checking-in team members, showing them to their rooms, making sure their luggage is transported to their rooms, bringing show tickets to team members, giving them restaurant advice, and so on. In general, a host may make sure that all the needs of team members are satisfied in a timely fashion. Thus, a host may be a large benefit provided to a team. In order to dedicate a host to a team, a casino may require that the team consist of at least a minimum number of people, that team members gamble for at least a certain amount of time, that team members make at least a minimum number of aggregate wagers, and so on. In order to benefit from having a host, a team may therefore strive to meet the requirements set forth by a casino. Therefore, casinos may benefit from attracting large enough groups of people to merit a host, and teams may benefit from having a host.

In various embodiments, one or more members of a team may receive other benefits if the team is large enough and/or if the team is providing the casino with enough play. For example, if a team has at least six members, and each of the team members plays for at least two hours during a particular day, each member of the team may receive a free ticket to a show. Other benefits may include free or discounted meals, free or discounted rooms, or free or discounted merchandise.

Just as a team of players may reserve a block of slot machines, a team may also reserve a block of hotel rooms (e.g., all adjacent to one another), a block of seats for a show, a block of seats by a pool, a special room or area at a spa or gym, and so on.

In one or more embodiments, one or more paylines from a group of gaming devices may be combined into a single grid, from which further paylines may be derived. For example, suppose that each of three group members is playing at his or her own gaming device with five reels and three symbols per reel visible at any one time. In other words, each group member sees a grid of symbols consisting of three rows and five columns. Now, after each group member generates an outcome at his or her respective gaming device, a group result may be derived by taking one row from each of the three gaming devices, combining the three rows into a three-by-five grid, and determining outcomes spanning the newly created paylines.

An example is illustrated in FIG. 19. Databases 1910, 1920, and 1930 each represent the result of a spin at one of three group members' gaming devices, with the paylines labeled by player and numbered "1," "2" and "3" for convenience. For instance, the first payline 1912 obtained by "player 1" consists of the symbols "cherry," "bell," "orange," "bar," and "cherry." The third payline 1926 obtained by "player 2" consists of the symbols "plum," "plum," "orange," "bell," and "orange."

The combined team result is illustrated by database 1940. The first payline 1942 of database 1940 is taken from the first payline 1912 of database 1910. Similarly, the second payline 1944 of database 1940 is taken from the second payline 1924 of database 1920. The third payline 1946 is taken from the third payline 1936 of database 1930.

Thus, by combining paylines from three different team members, a team result was made with an outcome of five cherries across one of the team paylines. The outcome of five cherries is formed from the cherries in line one 1942 and column one, in line two 1944 and column two, in line three 1946 and column three, in line two 1944 and column four, and in line one 1942 and column five, all of the combined team result 1940. The payline with the five cherries forms a "v". Additionally, the "cherry" text is illustrated in boldface in order for each symbol in order to highlight the payline.

Thus, in one or more embodiments, a slot server or other device may perform the following steps. The slot server may receive an indication of a first row of symbols from a first gaming device, in which the first row of symbols comprises a set of symbols that are displayed in a horizontal band across a display screen of the first gaming device. For example, the first row may represent the symbols on a payline of the first gaming device. The slot server may then receive an indication of a second row of symbols from a second gaming device. The slot server may then combine the first row and the second row to form a two-dimensional grid of symbols comprising at least two rows. For example, the slot server may stack the two rows one on top of the other. The slot server may determine a payline on the two-dimensional grid, the payline comprising a plurality of symbols, in which the payline is not a row of the grid. For example, the payline may be a diagonal or a column of the grid. The slot server may then determine a payout based on the plurality of symbols.

Although the above example illustrated the combination of paylines (or rows) from different team members, it should be appreciated that columns may also be combined. For instance five team members may each contribute a column of three symbols to a team result. Further, although the above example illustrated a team result in which each team member contributed one line, it should be noted that a team result may be derived from unequal contributions of the team members. In other words, one team member may contribute two lines while another contributes none. A gaming device, group of gaming devices, or slot server may automatically determine the lines (or other groups of symbols) that are to be contributed by each team member in order to make the most beneficial team outcome. The gaming device may also determine the most beneficial order in which to arrange the contributed lines in order to maximize the payout or other prize that will be paid to the team. However, there may be certain restrictions on how individual team members' results may contribute to a group result. For example, a team member may contribute either a whole payline, or nothing, but not just some symbols from a line.

In some embodiments, a team member may contribute a payline to a team result, such that the payline contributed is not a straight row. Rather, the payline may consist of the symbol in column one and row one, the symbol in column two and row two, the symbol in column three and row three, the symbol in column four and row three, and the symbol in column five and row three. The contributed payline may be "straightened out" in the team result so that the payline is now e.g., the first row of the team result.

In some embodiments, each player on a team has only one payline, in which case each player of the team may contribute his or her payline to form a team result, from which new paylines may be derived. Also, a team result may be formed from a subset of team members. For example, of four team members, three contribute their results to form a group result.

In various embodiments, a bonus round may include a sports-themed game involving the participation of two or more team members. In one or more of these games, a first team member may benefit from the play of a second team member. For example, in a baseball-themed game, each team member receives a payout based on the number of home-runs hit by the team member with the most home-runs hit. Exemplary games are described below.

In a baseball-themed game, two or more team members may engage in a "Home Run Derby." Each team member may then receive a payout based on the most home runs hit by any one of the team members. Alternatively, each team member may receive a payout based on the furthest-hit home run of any team member.

In a football-themed game, two or more team members may engage in a field-goal kicking contest. Each team member may receive a payout based on the longest successful field goal. Note that the games described herein may, on the one hand, feature a competition between team members. However, team members may, at the same time, benefit from the performance of others. So the competition may be especially friendly in that one team member may hope to be bested by another so as to receive an even higher payout.

In a riflery-themed game, two or more team members may engage in a contest to see who can hit the most targets, or who can get closest to the bull's eye of a target. Payouts may once again be based on the best riflery performance turned in by a team member.

In a bowling game, payouts for each team member may be based on the highest score achieved by any team member. A player's score may be determined based on a total number of pins knocked down, a total number of strikes achieved, a total number of spares achieved, and so on. In some cooperative embodiments, a first player may bowl a first ball to knock down a first subset of pins standing. A second player may then bowl a second ball to knock down a second subset of pins standing (e.g., to knock down the remaining pins standing). Players may thereby jointly contribute to a score which will determine payouts for both of them.

In a fishing game, a payout for each player may be based on the largest fish caught by any player, or based on the most number of fish caught by any player.

In a racing game, a payout for each player may be based on the fastest lap around a track achieved by any player.

In a game based on solving mysteries, (e.g., a Clue™-themed game), two or more team members may each have the opportunity to contribute to solving a mystery. A first player may choose a suspect, e.g., through active selection or through spinning a reel that lands on a suspect. The suspect may be the player's choice as to who committed a crime. A second player may choose a weapon which represents his choice of the weapon used in committing the crime. A third player may choose a location that represents his choice of the location in which the crime was committed. Each player on the team may then receive a payout based on the correspondence between the player's choices and what are deemed to be the actual circumstances of the crime. For example, the payout may be greater if two of the choices were correct than if none of the choices were correct.

In a game based on an eating contest, each member of a team may choose an avatar to represent him or her. The avatars may then compete to eat foods such as ice cream, hot dogs, or eggs. Each team member may then receive a payout based on the most food consumed by any of the avatars.

In a Leprechaun-themed game, each member of a team may try to catch as many Leprechauns as possible. Each team member may receive a payout based on the most Leprechauns caught by any one of the team members.

In game based on a theme from reality television, players compete to maintain a particular status for the longest amount of time. For example, as in the Survivor series, popular in the early twenty-first century, game characters may compete to remain on an island without being voted off. Players may receive a payout based on the longest-lasting character of any character on the team. Note that there may be other game characters that do not corresponding to any team member. These may be "house" characters, or may represent characters from other teams competing in the same bonus game. There may be a number of ways in which a reality television-themed game might be played. In one embodiment, players take turns spinning a wheel, or reels of their respective gaming devices. If a player's own character comes up on the reels, then that character may be voted off the game. Alternatively, the player's character may appear on the reels along with some benefit, such as immunity from being voted off for some number of future rounds, or handle pulls. In this way, as more and more handle pulls are completed, characters gradually disappear from the game until only one remains.

In a lottery-themed game, each member of a team may receive a lottery ticket. For example, a representation of a lottery ticket may be displayed on the display screen of each team member's gaming device. In some embodiments, each team member may have the opportunity to select the numbers that will appear on his/her lottery ticket. A common lottery drawing may then occur for all of the players. For example, the slot server determines six numbers at random. The lottery tickets of each team member are then compared to the six numbers determined by the slot server. Each member of the team may then receive a payout based on the most matches between any one of the team members' tickets, and the numbers drawn by the server. For instance, if there is one ticket among all the team members' tickets in which there are four matches, and four is the most matches of any ticket of the team members' tickets, then each team member may receive a payout based on the four matches. In some embodiments, each member of the team may receive a payout based on the total number of matches made amongst all the team members' tickets. For example, if one team member has two matches, another team member has one match and a third team member has one match, then there are four matches total. Each team member may then receive a payout based on four matches.

In a puzzle-themed game, each team member may work on a separate puzzle, striving to be the first one to complete his puzzle. Team members may have a limited amount of time and/or number of handle pulls in which to complete the puzzle. For example, each handle pull may bring a puzzle piece that may help to complete the puzzle. At the end of the game, each team member may receive a payout based on most complete of the team members' puzzles. For example, if the most complete puzzle is ninety percent complete, then each team member may receive a payout that corresponds to a ninety percent completion rate.

It will be appreciated that there are many other possible game formats amenable to team play, and that the present invention is not limited only to those games described herein. It will also be appreciated that various games described herein may be played from separate gaming devices that are all involved in the same game. Each gaming device may display a separate depiction of the game, yet the game may be common to several gaming devices. For instance, in a fishing game, an image of several team members' characters floating on a pond may be replicated on the display screens of each of the team members' gaming devices. When one team member takes an action that alters the game state, the altered game state may be displayed on each of the display screens of the team members' gaming devices.

It is to be understood that the embodiments and variations shown and described herein are merely illustrative of the principles of this invention and that various modifications may be implemented by those skilled in the art without departing from the scope and spirit of the invention.

We claim:

1. A method comprising:

defining a team of players, wherein membership in the team is independent of gaming devices on which the players play;

allowing members of the team to participate jointly in determining a single outcome for the team by:

accepting a first input from a first player at a first gaming device;

accepting a second input from a second player who is not the first player, the second player at a second gaming device which is not the first gaming device;

generating the single outcome for the team, and presenting the single outcome to the team as if the single outcome were a function of the first input and the second input, wherein the single outcome indicates a team payout for the team and is not formed from outcomes that define individual payouts.

2. The method of claim 1 further comprising presenting a grid of opaque symbols on display screens of each gaming device on which the players play and wherein behind each opaque symbol is a hidden game symbol.

3. The method of claim 2 wherein the hidden symbols are identical between team members.

4. The method of claim 3 wherein the grid has rows and columns.

5. The method of claim 4 wherein the first input from the first player is a selection of a row.

6. The method of claim 4 wherein the second input from the second player is a selection of a column.

7. The method of claim 6 wherein the first input from the first player is a selection of a row.

8. The method of claim 7 further comprising revealing a corresponding hidden symbol based on the row and column selections received.

9. The method of claim 8 further comprising providing the team payout.

10. The method of claim 1 wherein the first input comprises a first seed number.

11. The method of claim 10 wherein the second input comprises a second seed number.

12. The method of claim 11 further comprising combining the first and second seed numbers to make a combined seed.

13. The method of claim 12 wherein combining the first and second seed numbers comprises adding the first and second seed numbers.

14. The method of claim 12 wherein combining the first and second seed numbers comprises multiplying the first and second seed numbers.

15. The method of claim 12 further comprising using the combined seed in a random number generator to initialize the random number generator.

16. The method of claim 10 further comprising deriving the first seed number from a digital representation of a fingerprint provided by the first player.

17. The method of claim 1 wherein the first input comprises the first player initiating spinning of reels.

18. The method of claim 17 wherein the second input comprises the second player stopping the spinning of reels.

19. A computer readable medium comprising software with instructions adapted to:

define a team of players, wherein membership in the team is independent of gaming devices on which the players play;

allow members of the team to participate jointly in determining a single outcome for the team by:

accepting a first input from a first player at a first gaming device;

accepting a second input from a second player who is not the first player, the second player at a second gaming device which is not the first gaming device;

generating the single outcome for the team, and presenting the single outcome to the team as if the single outcome were a function of the first input and the second input, wherein the single outcome indicates a team payout for the team and is not formed from outcomes that define individual payouts.

20. A system comprising:

a first gaming device;

a second gaming device, which is not the first gaming device; and a controller operatively coupled to the first and second gaming devices and adapted to:

define a team of players, wherein membership in the team is independent of gaming devices on which the players play;

allow members of the team to participate jointly in determining a single outcome for the team by:

accepting a first input from a first player at the first gaming device;

accepting a second input from a second player who is not the first player, the second player at a second gaming device;

generating the single outcome for the team, and presenting the single outcome to the team as if the single outcome were a function of the first input and the second input, wherein the single outcome indicates a team payout for the team and is not formed from outcomes that define individual payouts.

21. A method comprising:

providing a first gaming device;

providing a second gaming device distinct from the first gaming device;

accepting a first input from a first player at the first gaming device;

accepting a second input from a second player at the second gaming device, wherein neither the first input nor the second input comprises indicia found on a paytable associated with either gaming device;

generating an outcome; and presenting the outcome to the first and second players as if the outcome were a function of the first input and the second input.

22. The method of claim 21 wherein the first input is a request to initiate spinning of reels.

23. The method of claim 22 wherein the second input is a request to halt the reels.

24. The method of claim 21 wherein the first input comprises a first seed number.

25. The method of claim 24 wherein the second input comprises a second seed number.

26. The method of claim 25 further comprising combining the first and second seed numbers to make a combined seed.

27. The method of claim 26 further comprising using the combined seed in a random number generator to generate the outcome.

28. A method comprising:

providing a first gaming device with a first display;

providing a second gaming device with a second display, wherein the second gaming device is not the first gaming device;

generating a grid comprising a plurality of columns and a plurality of rows;

populating the grid with symbols;

presenting the grid on the first display and the second display such that the symbols populating the grid are occluded;

receiving a first indication from a first player at the first gaming device indicating a first selection of a row from the plurality of rows;

receiving a second indication from a second player at the second gaming device indicating a second selection of a column from the plurality of columns; and revealing one of the symbols based on the first and second selections.

* * * * *